US005775126A

United States Patent [19]

Sato et al.

[11] Patent Number: 5,775,126

[45] Date of Patent: Jul. 7, 1998

[54] ADSORPTIVE-TYPE REFRIGERATION APPARATUS

[75] Inventors: Hiedaki Sato, Anjou; Masaaki Tanaka; Shin Honda, both of Nagoya; Kenichi Fujiwara; Satoshi Inoue, both of Kariya, all of Japan

[73] Assignee: Denso Corporation, Kariya, Japan

[21] Appl. No.: 816,433

[22] Filed: Mar. 14, 1997

[30] Foreign Application Priority Data

Mar. 14, 1996 [JP] Japan ..... 8-057727
Nov. 6, 1996 [JP] Japan ..... 8-293974

[51] Int. Cl.[6] ..... F25B 17/08

[52] U.S. Cl. ..... 62/480; 62/481

[58] Field of Search ..... 62/476, 480, 481, 62/477, 335, 101, 106

[56] References Cited

U.S. PATENT DOCUMENTS 5,157,938 10/1992 Bard et al. ..... 62/335
5,351,493 10/1994 Hiro et al. ..... 62/46.2
5,386,705 2/1995 Jones ..... 62/480
5,419,156 5/1995 Sywulka ..... 62/476
5,463,879 11/1995 Jones ..... 62/480
5,598,721 2/1997 Rockenfeller et al. ..... 62/480
5,619,866 4/1997 Sato et al. ..... 62/480

FOREIGN PATENT DOCUMENTS 5-042966 6/1993 Japan .
7-120100 5/1995 Japan .

*Primary Examiner*—William Doerrler
*Attorney, Agent, or Firm*—Cushman Darby & Cushman IP Group of Pillsbury Madison & Sutro LLP

[57] ABSTRACT

A differential in refrigerant adsorption rates of adsorbent during an adsorption process and during a desorption process is enlarged, realizing improvement in refrigeration capacity, and together therewith, the number of circulation systems for coolant fluid is reduced and the number of pumps is made smaller. A heat exchanger of a first stage evaporator and a cooler for air conditioning use are connected in series, and coolant fluid cooled by this heat exchanger is supplied to the cooler for air conditioning use. Additionally, a heat exchanger of a second stage evaporator and a radiator are connected in series, coolant fluid cooled by the radiator is further cooled by the heat exchanger, and this coolant fluid is alternately supplied to heat exchanging passages of first first stage and second stage adsorption devices and to heat exchanging passages of second first stage and second stage adsorption devices.

20 Claims, 22 Drawing Sheets

ADSORPTIVE-TYPE REFRIGERATION APPARATUS

BACKGROUND OF THE INVENTION

1. Field of the Invention

This invention relates to an adsorptive-type refrigeration apparatus for performing adsorption of refrigerant vaporized in an evaporator by chilling and heating of an adsorbent held by an adsorption device and for supplying refrigerant vapor to a condenser.

2. Description of Related Art

An adsorptive-type refrigeration apparatus which adsorbs refrigerant vapor vaporized by an evaporator by chilling adsorbent, and which desorbs refrigerant and supplies the same to a condenser by switching adsorbent to a heated state is known in the art.

Use of this kind of adsorptive-type refrigeration apparatus in an automotive air conditioner has recently been attempted, and a structural example thereof is shown in FIG. 25. In this drawing, adsorbent S and heat exchanging passages 3 and 4 are provided within first and second adsorption devices 1 and 2, and refrigerant outlets of these first and second adsorption devices 1 and 2 are connected via a three-way valve 5 to a condenser 6. Accordingly, the condenser 6 is connected to an evaporator 7, and the evaporator 7 further is connected via a three-way valve 8 to refrigerant inlets of the first and second adsorption devices 1 and 2.

Meanwhile, to alternately supply heating fluid and cooling fluid to the heat exchanging passages 3 and 4 of the first and second adsorption devices 1 and 2, a heating fluid supply pipe 9 and a coolant fluid supply pipe 10 are connected via three-way valves 11 and 12 to inlets of the heat exchanging passages 3 and 4, and outlets of the heat exchanging passages 3 and 4 are connected via three-way valves 13 and 14 to a heating fluid discharge pipe 15 and a coolant fluid discharge pipe 16.

Here, coolant water of an engine 17 is used as the heating fluid, and water chilled by a radiator 18 radiating heat to the atmosphere is used as the coolant fluid. The heating fluid supply pipe 9 and discharge pipe 15 are connected respectively to a coolant water outlet and a coolant water inlet of the engine 17, and the coolant fluid supply pipe 10 and discharge pipe 16 are connected respectively to an outlet and an inlet of the radiator 18.

Now, when the three-way valves 5, 8, and 11 through 14 are in the state shown by solid lines, heating fluid passes through the supply pipe 9, the three-way valve 11, the heat exchanging passage 3 of the first adsorption device 1, and the three-way valve 13, and is discharged from the discharge pipe 15. The coolant fluid passes through the supply pipe 10, the three-way valve 12, the heat exchanging passage 4 of the second adsorption device 2, and the three-way valve 14, and is discharged from the discharge pipe 16.

Accordingly, the adsorbent S within the first adsorption device 1 is heated by the heating fluid passing through the heat exchanging passage 3, and refrigerant which had been adsorbed thereto evaporates and is desorbed. This refrigerant vapor enters the condenser 6 via the three-way valve 5; herein, it exchanges heat with an external volume and is condensed, thereby becoming refrigerant liquid. Refrigerant liquid discharged from the condenser 6 is supplied to the evaporator 7, where it exchanges heat with an external area and is vaporized. The refrigerant vapor vaporized by the evaporator 7 passes through the three-way valve 8, enters the second adsorption device 2, and is adsorbed to the adsorbent S. Heat generated at the time of this adsorption of refrigerant vapor is usurped by coolant fluid flowing through the heat exchanging passage 4.

When desorption of refrigerant from the adsorbent S ends through the above-described operation, or the capacity of the adsorbent S to adsorb refrigerant declines, the three-way valves 5, 8, and 11 through 14 are switched from the state shown by solid lines to the state shown by broken lines. Because of this, a state occurs where heating fluid flows through the heat exchanging passage 4 of the second adsorption device 2 and coolant fluid flows through the heat exchanging passage 3 of the first adsorption device 1, opposite to the foregoing description, and so the second adsorption device 2 becomes the desorbing side and the first adsorption device 1 becomes the adsorbing side, and refrigerant vapor desorbed from the adsorbent S of the first adsorption device 2, after being condensed by the condenser 6, is evaporated by the evaporator 7 and adsorbed by the adsorbent S of the first adsorption device 1, and heat generated during adsorption thereof is usurped by coolant fluid flowing through the heat exchanging passage 3.

Accordingly, when desorption of refrigerant from the adsorbent S of the second adsorption device 2 ends, or the capacity of the adsorbent S of the first adsorption device 1 to adsorb refrigerant declines, the three-way valves 5, 8, and 11 through 14 are switched from the state shown by broken lines to the state shown by solid lines; thereafter, similarly to the foregoing, the first and second adsorption devices 1 and 2 alternately repeat an adsorption process and a desorption process.

In such an adsorptive-type refrigeration apparatus used in an automotive air conditioner according to the prior art, a pair of adsorption devices are provided in only one stage to alternately supply coolant fluid cooled by heat radiation of the radiator 18 and heating fluid (engine coolant water) heated by cooling the engine 17 to cause these paired adsorption devices to alternately execute an adsorption process and a desorption process.

In contrast thereto, an adsorptive-type refrigeration apparatus disclosed in Japanese Patent Application Laid-Open Publication No. Hei 7-120100 has a mode providing adsorption devices in multiple stages. As shown in FIG. 24, in this system an interior of a reactor 22 provided with adsorbent S and a heat exchanging passage 21 is partitioned into a plurality of chambers C1 through C7.

This apparatus is provided with valves V1 through V7 and V8 through V14 for opening and closing an interval between the several chambers C1 through C7 and a condenser 24 or an evaporator 25. During the desorption process, the heat transmitting fluid flows from the heat source 25 through the heat exchanging passage 21 to a cooling and heating source 26 in a state wherein the valves V1 through V7 are open and the valves V8 through V14 are closed; during the adsorption process, conversely, the heat transmitting fluid flows from the cooling and heating source 26 through the heat exchanging passage 21 to the heat source 25 in a state where the valves V8 through V14 are open and the valves V1 through V7 are closed.

In particular, when switching from the desorption process to the adsorption process, the open or closed states of the valves V1 through V14 are controlled in the following way. Namely, in a state where the desorption process has ended, the valves V1 through V7 for connecting the several chambers C1 through C7 to the condenser 24 are all opened and the valves V8 through V14 for connecting the several chambers C1 through C7 to the evaporator 25 are all closed.

To switch from this state where the desorption process has ended to the adsorption process, first, the valve V1 on the condenser 24 side of the first stage chamber C1 is closed, compressing a piston 27 of the cooling and heating source 26, and chilled heat transmitting fluid passes through the heat exchanging passage 21 and is allowed to flow toward the heat source 25. Thus, cooling of the first stage chamber C1 begins, and pressure thereof declines. Accordingly, when the first stage chamber C1 has reached a predetermined evaporation pressure, the valve V8 on the evaporator 24 side of the first stage chamber C1 is opened, and simultaneously thereto, the valve V2 on the condenser 23 side of the second stage chamber C2 is closed.

Thereupon, refrigerant vapor within the evaporator 24 is adsorbed to the adsorbent S of the first stage chamber C1, and along with this, cooling of the second stage chamber C2 is begun. Accordingly, when the second stage chamber C2 has reached a predetermined evaporation pressure, the valve V9 on the evaporator 24 side of the second stage chamber C2 is opened, and simultaneously thereto, the valve V3 on the condenser 23 side of the third stage chamber C3 is closed. Thereafter, similarly, the valves V3 through V7 are successively closed, and along with this, the valves V10 through V14 are successively opened, and ultimately the valves V1 through V7 on the condenser 23 are all opened and the valves V8 through V14 on the evaporator 24 side are all closed.

By controlling the valves V1 through V14 in this way, it becomes possible to obtain a steep temperature front, and an attempt is made to preheat the heat transmitting fluid by liquefaction latent heat of the adsorbent S and boost thermal efficiency when switching from the adsorption process to the desorption process, and along with this, to increase desorption efficiency.

In a case where an adsorptive-type refrigeration apparatus is used in an automotive air conditioner, heating fluid (engine coolant water) of sufficiently high temperature can be obtained by using the engine as a heat source. However, because an automobile is not provided with a cooling and heating source, water cooled by a radiator 18 which radiates heat to the atmosphere must perforce be employed, as was described with reference to FIG. 25, and as a result thereof, coolant fluid of sufficiently low temperature cannot be obtained.

For this reason, there existed a problem in that adsorption temperature during adsorption of adsorbent is high compared with evaporation temperature of refrigerant in an evaporator, and it becomes correspondingly impossible to sufficiently exhibit the adsorbing capacity of the adsorbent, and chilling (cooling) capacity is not sufficiently obtained.

Furthermore, such problems are not solved by the adsorptive-type refrigeration apparatus disclosed in Japanese Patent Application Laid-open No. 7-120100.

SUMMARY OF THE INVENTION

In light of the foregoing circumstances, it is an object of the present invention to provide an adsorptive-type refrigeration apparatus which can amply exhibit adsorption capacity of adsorbent and can demonstrate high cooling capacity.

The above object is achieved according to a first aspect of the present invention by providing an adsorptive-type refrigeration apparatus in which multiple stages of evaporators and adsorption devices are provided in a one-to-one relationship to supply coolant fluid cooled by the evaporators to a heat exchanging passage of an adsorption device of a prior stage. For this reason, when refrigerant vapor vaporized by the several stages of evaporators is adsorbed by adsorbent of the adsorption devices, the cooling temperature of the adsorbent due to the coolant fluid can be approached with respect to the temperature of the refrigerant vapor, and so a difference between adsorption rate during adsorption of the adsorbent and adsorption rate during desorption can be large. Consequently, a large quantity of refrigerant vapor can be supplied to the condenser with a small quantity of adsorbent, and so cooling capacity can be heightened while avoiding an increase in apparatus size.

In particular, heat exchanging passages of at least two mutually adjacent stages of adsorption devices among the plurality of stages of adsorption devices are connected in series, or passages of coolant fluid chilled by at least mutually adjacent evaporators among the plurality of stages of evaporators are connected in series, and so even when adsorption devices of a plurality of stages exist, the number of circulation paths to supply coolant fluid thereto can be small, and simplification of piping configuration can be accomplished.

In this case, heat exchanging passages of several stages of adsorption devices and a radiator which radiates heat to an external volume and a plurality of heat exchangers cooled by several stages of evaporators and a cooler for cooling outside air are connected in series, and coolant fluid cooled by the radiator further is successively cooled by heat exchangers from the final stage evaporator to the first stage evaporator. Accordingly, the coolant fluid thereof firstly is supplied to a chiller to cool an external area, and thereafter is successively supplied to the heat exchanging passages from the first stage adsorption device to the final stage adsorption device, and due to this structure the circulation path of the coolant fluid can be made to be a single path.

An adsorbent's speed of adsorbing refrigerant vapor increases as pressure becomes higher, even at identical relative humidity. Because evaporation pressure of refrigerant adsorbed by the plurality of stages of adsorption devices becomes increasingly higher at successively later stages, adsorption speed is increasingly faster for adsorbent at successively later stages. Because of this, compactness of the adsorption device can be achieved by reducing the filled quantity of adsorbent in adsorption devices at increasingly later stages among the plurality of stages of adsorption devices, and moreover there is no danger of loss in adsorption capacity of refrigerant even when such compactness is realized.

Additionally, because surface area per unit weight increases as particle size of adsorbent becomes smaller, adsorption speed of refrigerant vapor becomes faster. Conversely, however, the ability of the refrigerant vapor to penetrate within the adsorbent layer becomes poorer as particle size grows smaller. Ideal particle size of the adsorbent is determined by superposition of these two conditions. However, the ability of the refrigerant vapor to penetrate within the adsorbent layer increases as pressure becomes greater. In this regard, compactness of the adsorption device can be realized with no loss in adsorption capacity of refrigerant by causing particle size of adsorbent to become increasingly smaller in adsorption devices of successively later stages, where pressure of refrigerant vapor is high.

There may be cases where cooling of outside air by the cooler to around 0° C. is desired. To obtain 0° C. with the cooler, it is necessary in consideration of heat exchange efficiency to set the refrigerant evaporation temperature to about −5° C. with the first stage evaporator, but when the refrigerant is distilled water, it freezes at such a low temperature. In this regard, employment of water compounded with a gelation point lowering agent as coolant fluid may be considered, but a gelation point lowering agent may cause problems such as a reduction of cooling capacity, corrosion, or the like. In connection with this matter, the condenser may be multiply provided to correspond to the several stages of evaporators and adsorption devices, so that a circulating system of refrigerant is independently established for each of the several stages, and among refrigerant sealed within these several stages of condensers, evaporators, and adsorption devices, a gelation point lowering agent is intermixed in refrigerant of a required stage of a forward stage side. Because of this, usage of a gelation point lowering agent with which there exists a chance of bringing about problems such as a reduction of cooling capacity, corrosion, or the like can be restricted to a minimal range on the front stage side.

In this case, a required stage of a forward stage side may employ an alcohol-based substance as refrigerant and may employ activated carbon as adsorbent to adsorb. When this is done, freezing of the refrigerant can reliably be prevented because the temperature at which the alcohol-based substance freezes is low, and smaller quantities of adsorbent can be used because the activated carbon readily adsorbs the alcohol-based substance.

The heat exchanging passages of the several stages of adsorption devices, when viewed all together, make up a counterflow heat exchanger. However, when structured so that coolant fluid discharged from the radiator and coolant fluid discharged from the cooler are intermixed and supplied to a heat exchanger of the final stage evaporator and a heat exchanging passage of the first stage adsorption device, temperature of coolant fluid flowing into the heat exchanging passage of the first stage adsorption device becomes high, and so the amount of head dissipated during refrigerant adsorption of the adsorbent is reduced, and heat exchange efficiency is heightened.

The stages of adsorption devices are disposed in pairs, and each pair of adsorption devices alternately execute an adsorbing process and a desorbing process through a relationship wherein when one performs adsorption through coolant fluid being supplied to its heat exchanging passage, another performs desorption through heating fluid being supplied to its heat exchanging passage, and when these processes are switched, after the heat exchanging passages of several stages of adsorption devices have passed through a state wherein adsorption device heat exchanging passages in which an execution process prior to switching and an execution process subsequent to switching are identical are connected in series, adsorption device heat exchanging passages wherein an identical process is executed subsequently to switching are connected in series.

According to this structure, coolant fluid or heating fluid remaining within the several stages of heat exchanging passages at a time of process switching is supplied the heat exchanging passage of the adsorption device which executes the adsorption process or desorption process after switching, and so time interval until an adsorption device in particular on a later stage side reaches a state where adsorption or desorption can actually be performed is short.

Other objects and features of the present invention will appear in the course of the description thereof, which follows.

BRIEF DESCRIPTION OF THE DRAWINGS

Additional objects and advantages of the present invention will be more readily apparent from the following detailed description of preferred embodiments thereof when taken together with the accompanying drawings in which.

DETAILED DESCRIPTION OF THE PRESENTLY PREFERRED EXEMPLARY EMBODIMENTS

Specific embodiments of this invention as used in an automotive air conditioner will be described hereinafter.

FIGS. 1–4 show a first preferred embodiment of the present invention. This embodiment is provided with two stages of evaporators and adsorption devices, and the adsorption devices of the respective stages are made up of two adsorption devices to alternately repeat a desorption process and an adsorption process through a relationship where while one is performing the desorption process, the other is executing the adsorption process.

Figure 1:
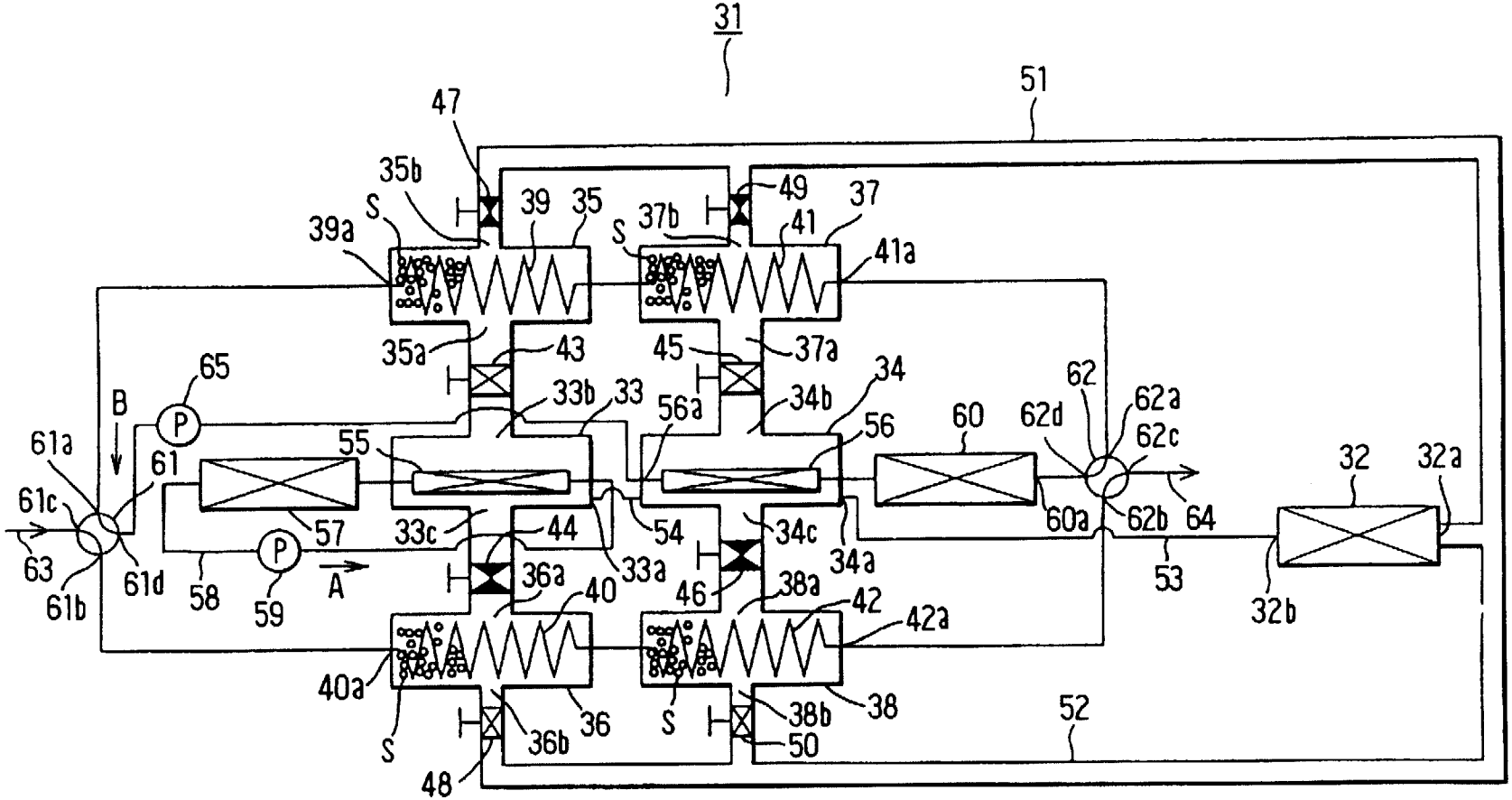
FIG. 1 is a drawing schematically showing an overall structure of an adsorptive-type refrigeration apparatus according to a first preferred embodiment of the present invention.
Figure 2:
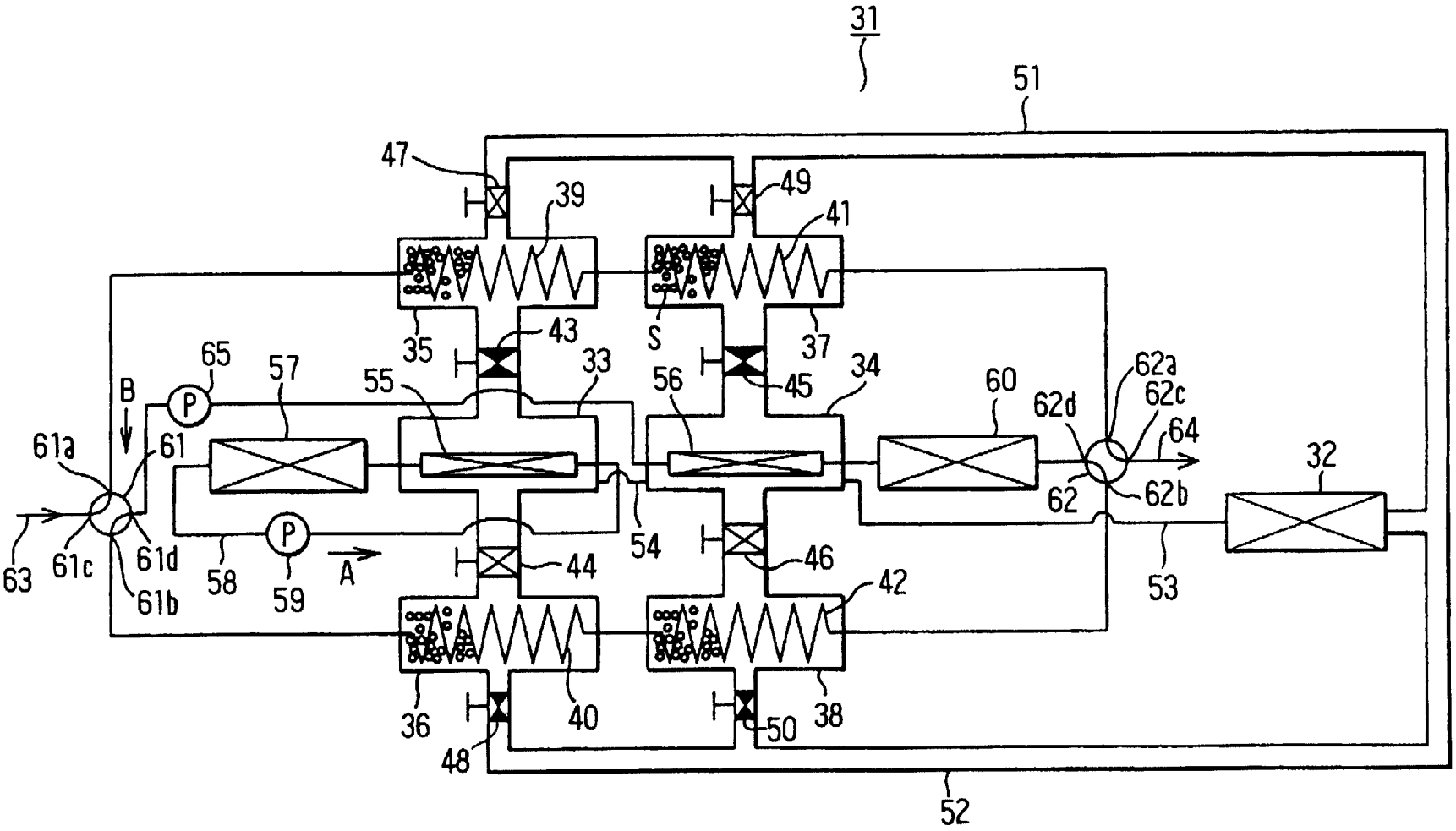
FIG. 2 shows the first embodiment switched to a second state.

FIGS. 1 and 2 show an overall system structure of an adsorptive-type refrigeration apparatus 31 in mutually differing states. This adsorptive-type refrigeration apparatus 31 includes, for example, one condenser 32, a first stage evaporator 33, a second stage evaporator 34, first and second first stage adsorption devices 35 and 36 corresponding to the first stage evaporator 33, and first and second second stage adsorption devices 37 and 38 corresponding to the second stage evaporator 34. These are disposed in the car's engine compartment.

The condenser 32 condenses refrigerant vapor supplied through an inlet 32*a*, and discharges the condensed vapor as liquid refrigerant from an outlet 32*b*. The respective evaporators 33 and 34 evaporate refrigerant liquid supplied to inlets 33*a* and 34*a*, and discharge the evaporant from outlets 33*b*, 33*c*, 34*b* and 34*c*.

Meanwhile, the adsorption devices 35 through 38 house adsorbent S in the form of numerous particles in a receptacle, and along with this, provide heat exchanging passages 39 through 42 to perform heat exchange with this adsorbent S. Accordingly, when low temperature coolant fluid is flowing through the heat exchanging passages 39 through 42, adsorbent S cooled by this coolant fluid passes through inlets 35*a* through 38*a* and adsorbs refrigerant vapor. When high temperature heating fluid is flowing through the heat exchanging passages 39 through 42, the adsorbent S warmed by this heating fluid desorbs refrigerant, thereby causing it to become refrigerant vapor, and discharges this vapor from outlets 35*b* through 42*b*. Water, for example, is used as the refrigerant, and silica gel, zeolite, activated carbon, activated alumina, or the like is used as the adsorbent S.

The condenser 32 and the evaporators 33 and 34 are alternately connected by a path (piping structure) as will be described below with respect to the adsorption devices 35 through 38 to adsorb and desorb refrigerant as was described above. Namely, of the first and second first stage adsorption devices 35 and 36 corresponding to the first stage evaporator 33, the inlets 35*a* and 36*a* thereof are connected via switching valves 43 and 44 to the outlets 33*b* and 33*c* of the first stage evaporator 33. Of the first and second second stage adsorption devices 37 and 38 corresponding to the second stage evaporator 34, the inlets 37*a* and 38*a* thereof are connected to the outlets 34*b* and 34*c* of the second stage evaporator 34.

Accordingly, the outlets 35*b* through 38*b* of the several adsorption devices 35 through 38 are connected via outlet-side switching valves 47 through 50 to refrigerant vapor passages 51 and 52, and these refrigerant vapor passages 51 and 52 are connected to the inlet 32*a* of the condenser 32.

The outlet 32*a* of the condenser 32 is connected to the inlet 34*a* of the second stage evaporator 34 via a capillary tube 53 which doubles as a restrictor serving as a refrigerant liquid passage, and furthermore, the inlet 33*a* of the first stage evaporator 33 is connected to this second stage evaporator 34 via a capillary tube 54 serving as a refrigerant liquid passage. Due to this, refrigerant liquid condenses by the condenser 32 is supplied sequentially to the second stage evaporator 34 and the first stage evaporator 33.

Heat exchangers 55 and 56 are disposed in an internal portion of the two evaporators 33 and 34, and heat exchanging fluid (for example, water) in an internal portion of these heat exchangers 55 and 56 is cooled by latent heat of vaporization of refrigerant liquid of the evaporators 33 and 34. Of these, the heat exchanger 55 of the first stage evaporator 33 is for external area cooling use, i.e., is used to cool air blown in a passenger compartment of a car through a vent duct (not shown) of an automotive air conditioner.

The heat exchanger 55 for external cooling use is connected via a circulation path 58 to a cooler for air conditioning use 57. Heat exchanging fluid cooled by latent heat of vaporization of refrigerant liquid in the first stage evaporator 33 is sent in the direction of arrow A by a pump 59 disposed in the circulation path 58 to be circulated between the heat exchanger 55 and the cooler for air conditioning use 57.

Here, to cool air blown into the passenger compartment by latent heat of vaporization of refrigerant liquid in the first stage evaporator 33, it is sufficient to dispose the first stage evaporator 33 directly within the vent duct of the automotive air conditioner, but cooling air flowing within the vent duct via the heat exchanger 55 and the cooler for air conditioning use 57, as in this embodiment, refrigerant piping for causing refrigerant vapor which has been vaporized by the first stage evaporator 33 to be returned to the first first stage adsorption device 35 or the second first stage adsorption device 36 need not be deployed for a great length between the engine compartment in the passenger compartment in circumstances where piping of large diameter must be employed.

Meanwhile, the heat exchanger 56 of the second stage evaporator 34 is employed for generating coolant fluid supplied to the heat exchanging passages 39 through 42 of the adsorption devices 35 through 38. This heat exchanger 56 is connected in series with the radiator 60 which radiates heat to the atmosphere, and coolant fluid which has been cooled by the thermal radiation of the radiator 60 is further cooled by latent heat of vaporization of refrigerant liquid in the second stage evaporator 34.

In addition to coolant liquid cooled by the radiator 60 and the heat exchanger 56, high temperature heating fluid may be supplied to the heat exchanging passages 29 through 42 of the adsorption devices 35 through 38, but in this embodiment, engine coolant water is used as the heating fluid.

In this case, when one of the pair comprising the first first stage adsorption device 35 and the first second stage adsorption device 37 and the pair comprising the second first stage adsorption device 36 and the second second stage adsorption device 38 is executing an adsorption process, the other is executing a desorption process. Through this relationship, these two pairs alternately repeat the adsorption process and the desorption process. For this reason, the supply path of the coolant fluid and the heating fluid is structured as will be described hereinafter.

First, the heat exchanging passages 39 and 41 of the first first stage adsorption device 35 and the first second stage adsorption device 37 are connected in series, the inlet 39*a* of the heat exchanging passage 39 is connected to a first port 61*a* of an inlet-side four-way valve (4-port, 2-position value) 61, and the outlet 41*a* of the heat exchanging passage 41 is connected to a first port 62*a* of an outlet-side four-way valve (4-port, 2-position value) 62. Additionally, the heat exchangers 40 and 42 of the second first stage adsorption device 36 and the second second stage adsorption device 38 are connected in series, the inlet 40*a* of the heat exchanging passage 40 is connected to a second port 61*b* of the inlet-side four-way valve 61, and the outlet 42*b* of the heat exchanging passage 42 is connected to a second port 62*b* of the outlet-side four-way valve 62.

Meanwhile, a circulation path pipe 63 and a return path pipe 64 are connected to a coolant water discharge port and intake port of the engine (not shown). Accordingly, the circulation path pipe 63 is connected to a third port 61*c* of the inlet-side four-way valve 61, and the return path pipe 64 is connected to a third port 62*c* of the outlet-side four-way valve 62. Also, of the radiator 60 and heat exchanger 56 connected in series to generate coolant fluid, an outlet 56*a* of the heat exchanger 56 is connected to a fourth port 61*d* of the inlet-side four-way valve 61 via a pump 65 to send coolant fluid in the direction of arrow B, and along with this, an inlet 60*a* of the radiator 60 is connected to a fourth port of the four-way valve 62.

The four-way valves 61 and 62 are structured to be switched between a first state shown in FIG. 1 and a second state shown in FIG. 2. Accordingly, in the first state, the inlet-side four-way valve 61 connects the first port 61*a* and the fourth port 61*d*, and connects the second port 61*b* and the third port 61*c*; similarly, the outlet-side four-way valve 62 as well connects the first port 62*a* and the fourth port 62*d*, and connects the second port 62*b* and the third port 62*c*.

Because of this, heating fluid discharged from the engine is circulated to flow from the heat exchanging passage 40 of the second first stage adsorption device 36 to the heat exchanging passage 42 of the second second stage adsorption device 38 and be returned to the engine, and along with this, coolant fluid cooled by the radiator 60 and the heat exchanger 56 of the second stage evaporator 34 is circulated to flow from the heat exchanging passage 39 of the first first stage adsorption device 35 to the heat exchanging passage 41 of the first second stage adsorption device 37 and be returned to the radiator 60.

Additionally, when the four-way valves 61 and 62 are switched to the second state, shown in FIG. 2, the inlet-side four-way valve 61 connects the first port 61*a* and the third port 61*c*, and connects the second port 61*b* and the fourth port 61*d*; similarly, the outlet-side four-way valve 62 as well connects the first port 62*a* and the third port 62*c*, and connects the second port 62*b* and the fourth port 62*d*.

Because of this, heating fluid discharged from the engine is circulated to flow from the heat exchanging passage 39 of the first first stage adsorption device 35 to the heat exchanging passage 41 of the first second stage adsorption device 37 and be returned to the engine, and along with this, coolant fluid cooled by the radiator 60 and the heat exchanger 56 of the second stage evaporator 34 is circulated to flow from the heat exchanging passage 40 of the second first stage adsorption device 36 to the heat exchanging passage 42 of the second second stage adsorption device 38 and be returned to the radiator 60.

Accordingly, the four-way valves 61 and 62 are of the electromotive type (for example, rotary-type devices driven by a motor) and are controlled along with the above-described switching valves 43 through 50 by a controller (ECU) as a controlling device provided with a microprocessor. In this case, the four-way valves 61 and 62 and the switching valves 43 through 50 are controlled to switch and be actuated at every occurrence of a fixed interval (for example, 60 seconds).

The switching period of the four-way valves 61 and 62 and the switching valves 43 through 50 is established at a time, previously determined through experimentation or theoretically, required by the adsorbent S for desorption or adsorption.

A mode of operation of the above-described structure will be described hereinafter.

When an operation switch of the automotive air conditioner is switched on, the controller, as was described above, controls the two four-way valves 61 and 62 and the switching valves 43 through 50 so that when one pair among the pair made up of the first first stage adsorption device 35 and the first second stage adsorption device 37 and the pair made up of the second first stage adsorption device 36 and the second second stage adsorption device 38 is in the adsorption process, the other pair executes the desorption process. In FIGS. 1 and 2, an open state of the switching valves 43 through 50 is shown as white, and a closed state thereof is shown as black.

Now, as shown in FIG. 1, the state is taken to be such that the pair made up of the first first stage adsorption device 35 and the first second stage adsorption device 37 is taken to be in a state of executing the adsorption process, and the pair made up of the second first stage adsorption device 36 and the second second stage adsorption device 38 is executing the desorption process. In this state, the first first stage adsorption device 35 and the first second stage adsorption device 37 respectively communicate with the first stage evaporator 33 and the second stage evaporator 34 by opening the switching valves 43 and 45, and along with this, the condenser 32 is in a closed state due to closure of the switching valves 47 and 49, and the heat exchanging passages 39 and 41 thereof receive a supply of coolant fluid. Additionally, the second first stage adsorption device 36 and the second second stage adsorption device 38 communicate with the condenser 32 by opening the switching valves 48 and 50, and along with this, the first stage evaporator 33 and the second stage evaporator 34 are in a closed state due to closure of the switching valves 44 and 46, and the heat exchanging passages 40 and 42 thereof receive a supply of heating fluid.

Because of this, adsorbent S of the first first stage adsorption device 35 and the first second stage adsorption device 37 is cooled and exhibits an adsorption effect, and so coolant liquid which has been collected in the first stage evaporator 33 and the second stage evaporator 34 is vaporized, and the vaporized coolant vapor is adsorbed respectively to the first first stage adsorption device 35 and the first second stage adsorption device 37. Due to the latent heat of vaporization of refrigerant of the first stage adsorption device 33 at this time, heat exchange refrigerant flowing within the heat exchanger 55 is cooled, and due to this, the cooler for air conditioning use 57 exhibits a chilling effect and chills air flowing within the vent duct.

Meanwhile, because adsorbent S of the second first stage adsorption device 36 and the second second stage adsorption device 38 is heated by heating fluid, refrigerant which had been adsorbed to this adsorbent S is desorbed, and the refrigerant vapor produced by this desorption is supplied to the condenser 32, where it is cooled by heat exchange with the atmosphere and condenses. Accordingly, the refrigerant liquid condensed by the condenser 32 is supplied to the second stage evaporator 34 and the first stage evaporator 33, and here it is vaporized and adsorbed respectively to adsorbent S of the first first stage adsorption device 35 and the first second stage adsorption device 37.

Accordingly, latent heat of condensation released from the refrigerant due to the adsorption effect of adsorbent S in the first first stage adsorption device 35 and the first second stage adsorption device 37 is usurped by coolant fluid flowing through the heat exchanging passages 39 and 41.

Coolant fluid, the temperature of which has been elevated by this usurpation of latent heat of condensation, is successively circulated first to be cooled by radiating heat to the atmosphere at the radiator 60, thereafter to be further cooled by latent heat of vaporization at the second stage evaporator 34 in the heat exchanger 56, and thereafter to flow again to the heat exchangers 39 and 41 of the first first stage adsorption device 35 and the first second stage adsorption device 37.

When such a state has continued for a fixed time, the adsorption capacity of adsorbent S of the first first stage adsorption device 35 and the first second stage adsorption device 37 declines, and desorption of adsorbent S in the second first stage adsorption device 36 and the second second stage adsorption device 38 ends. When this occurs, the four-way valves 61 and 62 and the switching valves 43 through 50 are switched to the state shown in FIG. 2, and so the first first stage adsorption device 35 and the first second stage adsorption device 37 communicate with the condenser 32 by opening of the switching valves 47 and 49 and are cut off respectively from the first stage evaporator 33 and the second stage evaporator 34 by closing the switching valves 43 and 45, and along with this, the heat exchanging passages 39 and 41 thereof receive a supply of heating fluid.

Additionally, the second first stage adsorption device 36 and the second second stage adsorption device 38 communicate with the first stage evaporator 33 and the second stage evaporator 34 by opening the switching valves 44 and 46 and are cut off from the condenser 32 by closing the switching valves 48 and 50, and along with this, the heat exchanging passages 40 and 42 thereof receive a supply of coolant fluid.

Because this state in FIG. 2 is merely a state wherein the adsorption process and the desorption process are performed by the opposite pairs of the state in FIG. 1, namely so that the pair made up of the first first stage adsorption device 35 and the first second stage adsorption device 37 performs the desorption process and the pair made up of the second first stage adsorption device 36 and the second second stage adsorption device 38 performs the adsorption process, detailed description of this state will be omitted. Accordingly, when this state in FIG. 2 has continued for a fixed time, the four-way valves 61 and 62 and the switching valves 43 through 50 are switched to the state shown in FIG. 1, and in this way the first first stage adsorption device 35 and the state of FIG. 1 and the state of FIG. 2 are alternately repeated at every occurrence of a fixed interval.

In this way, according to this embodiment, coolant fluid cooled by the radiator 60 is further cooled by the heat exchanging passages 39 and 41 of the first first stage adsorption device 35 and the first second stage adsorption device 37 or is supplied to the heat exchanging passages 40 and 42 of the second first stage adsorption device 36 and the second second stage adsorption device 38, and so overall cooling performance of the adsorptive-type refrigeration apparatus 31 can be heightened without causing the adsorption devices 35 to 38 to be large.

This matter will be described through comparison with the adsorptive-type refrigeration apparatus according to the prior art shown in FIG. 25.

Firstly, minimum adsorption rate during desorption by an adsorption device is determined by dew point temperature of the refrigerant, i.e., the condensation temperature in the condenser, and by the heating temperature of the adsorbent, i.e., the temperature of the heating fluid; maximum adsorption rate during adsorption by an adsorption device is determined by dew point temperature of the refrigerant, i.e., the vaporization temperature of the refrigerant fluid in the evaporator, and by the chilling temperature of the adsorbent, i.e., the temperature of the coolant fluid. Accordingly, refrigerant corresponding to the differential of this minimum adsorption rate and maximum adsorption rate is supplied to the condenser and the evaporator, and a refrigerating (cooling) effect is exhibited in the evaporator. Because of this, it can be said that the larger the difference between the minimum adsorption rate during desorption and the maximum adsorption rate during adsorption, the higher the refrigeration capacity.

Here, temperature of the engine coolant water which is the heating fluid is taken to be 90° C., condensation temperature of refrigerant in the condenser cooled by the atmosphere is taken to be 40° C., coolant fluid cooled in the radiator is taken to be 30° C., and vaporization temperature of refrigerant in the evaporator for cooling air blown into the passenger compartment is taken to be 10° C.

Figure 4:
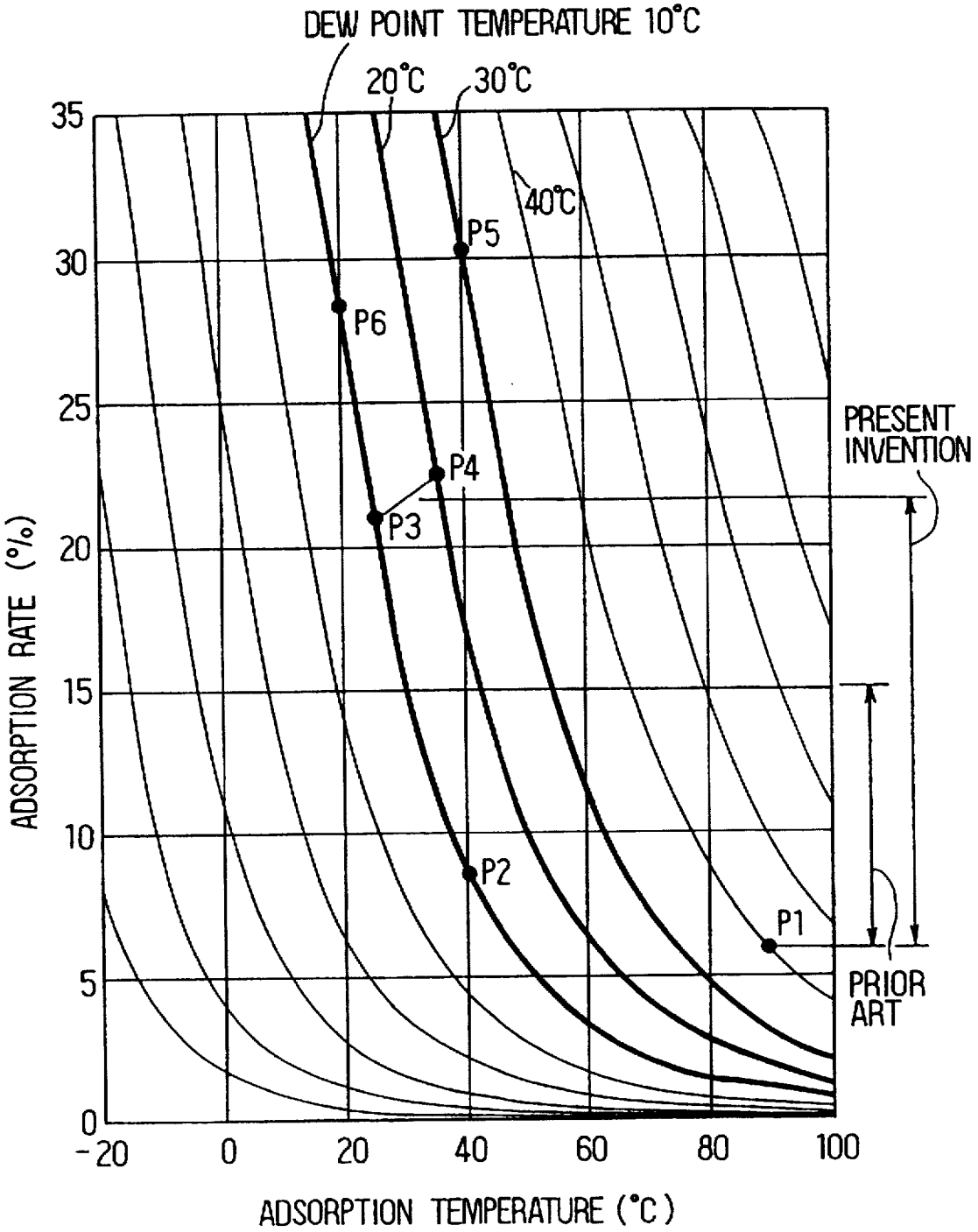
FIG. 4 is an adsorption rate/temperature characteristic diagram of adsorbent.
Figure 25:
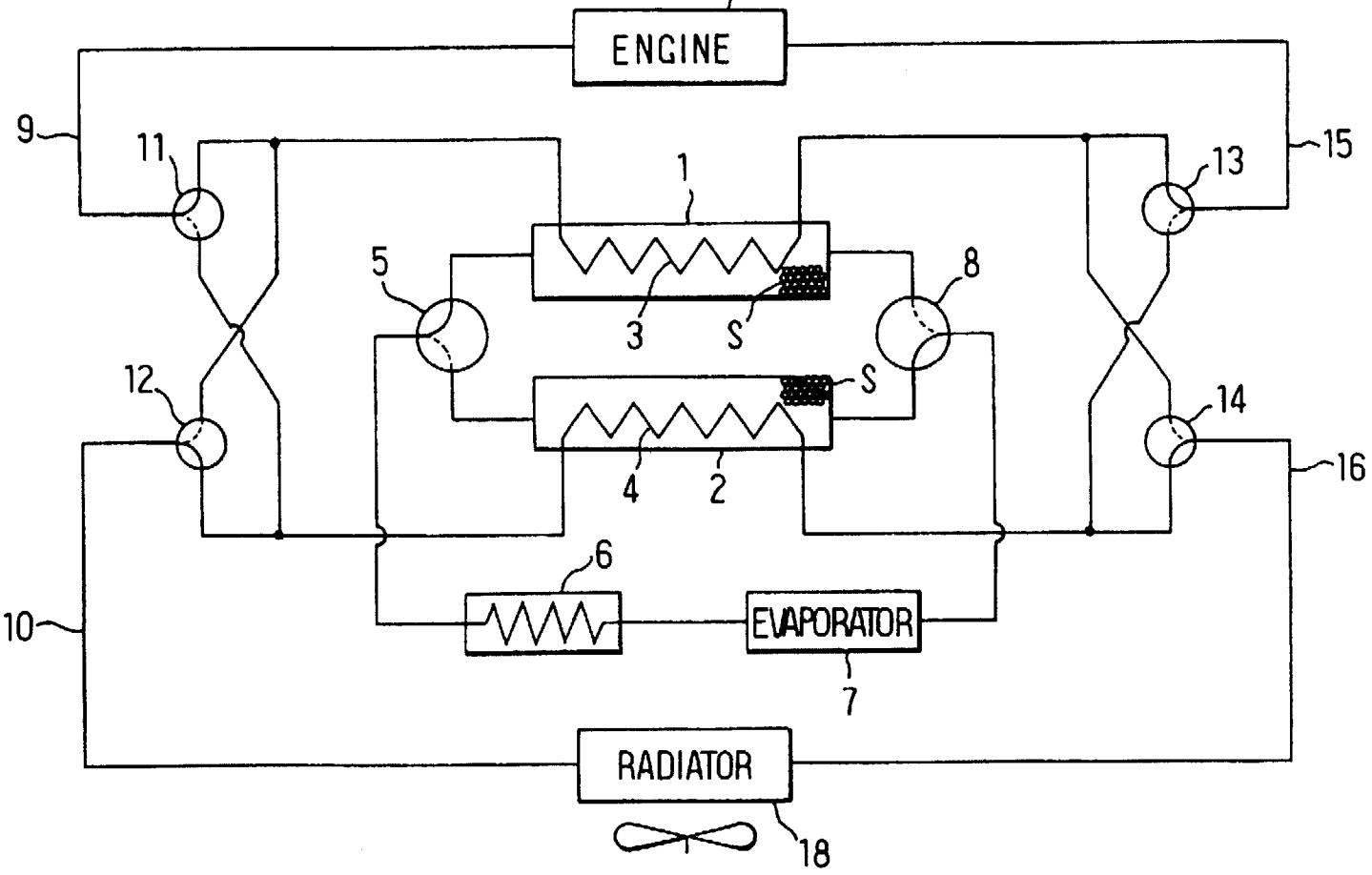
FIG. 25 PRIOR ART
FIG. 25 shows another example of an adsorptive-type refrigeration apparatus according to the prior art.

Accordingly, with an apparatus having the structure according to the prior art in FIG. 25, refrigerant vapor adsorbed from adsorbent S heated to 90° C. by heating fluid is cooled to 40° C. and condensed by a condenser 6, and so adsorbent S desorbs refrigerant until the adsorption rate reaches approximately 6%, as is shown by point P1 in the moisture adsorption rate/temperature characteristic diagram of FIG. 4.

In the example of this present embodiment as well, this adsorption rate of adsorbent S in the desorption process is such that refrigerant vapor desorbed from adsorbent S heated to 90° C. by heating fluid in the first first stage and second stage adsorption devices 35 and 37 or by the second first stage and second second stage adsorption devices 36 and 38 is cooled to 40° C. and condensed by the condenser 32, and so adsorbent S of the several adsorption devices 35 through 38 similarly desorbs refrigerant until the adsorption rate reaches approximately 6%.

Meanwhile, in the adsorption process, with the apparatus according to the prior art in FIG. 25, refrigerant vapor vaporized at 10° C. in an evaporator 7 is adsorbed by adsorbent S cooled to 30° C. by coolant fluid, and so at this time adsorbent S adsorbs refrigerant until the adsorption rate reaches approximately 8%, as shown by point P2 in FIG. 4. Consequently, an amount equivalent to the differential with respect to time of desorption of approximately 9% is the refrigerant quantity adsorbed and desorbed by adsorbent S, and with this, an immense quantity of adsorbent S would be required to supply a sufficient quantity of refrigerant fluid to the evaporator 7 and obtain sufficient refrigeration capacity.

Figure 3:
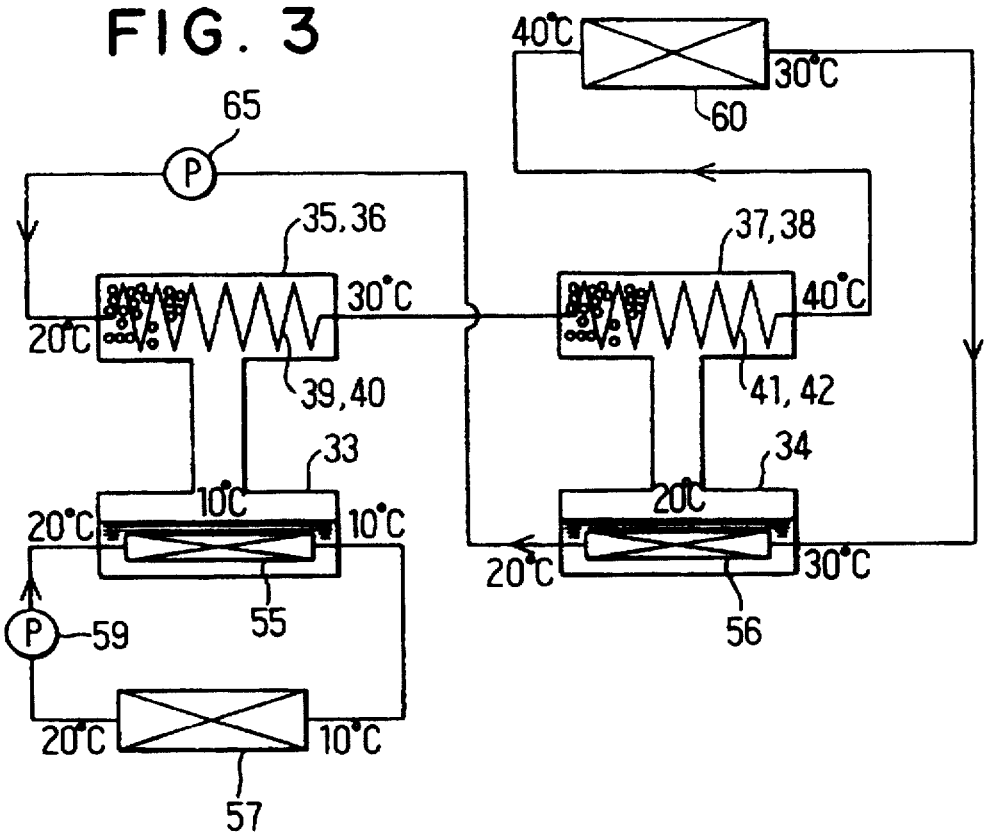
FIG. 3 is a schematic view showing solely a circulation system of coolant fluid in the first embodiment.

In contrast to this, according to this embodiment, coolant fluid is circulated to be cooled to 30° C. by the radiator 60 and is further cooled to 20° C. by the second stage evaporator 34, thereafter is provided to cool adsorbent S of the first first stage adsorption device 35 or the first second stage adsorption device 37 and rises in temperature from 20° C. to 30° C., is provided to cool adsorbent S of the second first stage adsorption device 36 or the second second stage adsorption device 38 and rises in temperature from 30° C. to 40° C., and is cooled by the radiator 60 to 30° C., as shown in FIG. 3, which shows solely a circulation system of coolant fluid.

Because of this, adsorbent S in the first stage adsorption devices 35 and 36 cooled to a mean temperature of 25° C. adsorbs refrigerant vapor of 10° C., and adsorbent S in the second stage adsorption devices 37 and 38 cooled to mean temperature of 35° C. adsorbs refrigerant vapor of 20° C., and so the adsorption rate of adsorbent S in the first stage adsorption devices 35 and 36 is approximately 21%, as shown by point P3 in FIG. 4, and the adsorption rate of adsorbent S in the second stage adsorption devices 37 and 38 is approximately 23%, as shown by point P3 in the same drawing. Consequently, the refrigerant quantity adsorbed and desorbed by adsorbent S in the first stage adsorption devices 35 and 36 is approximately 15% and refrigerant quantity adsorbed and desorbed by adsorbent S in the second stage adsorption devices 37 and 38 is approximately 17%; thus, the refrigerant quantity adsorbed and desorbed is increased over the structure according to the prior art in FIG. 25. For this reason, refrigeration capacity can be heightened while avoiding large size of the adsorption devices 35 through 38.

Figure 23:
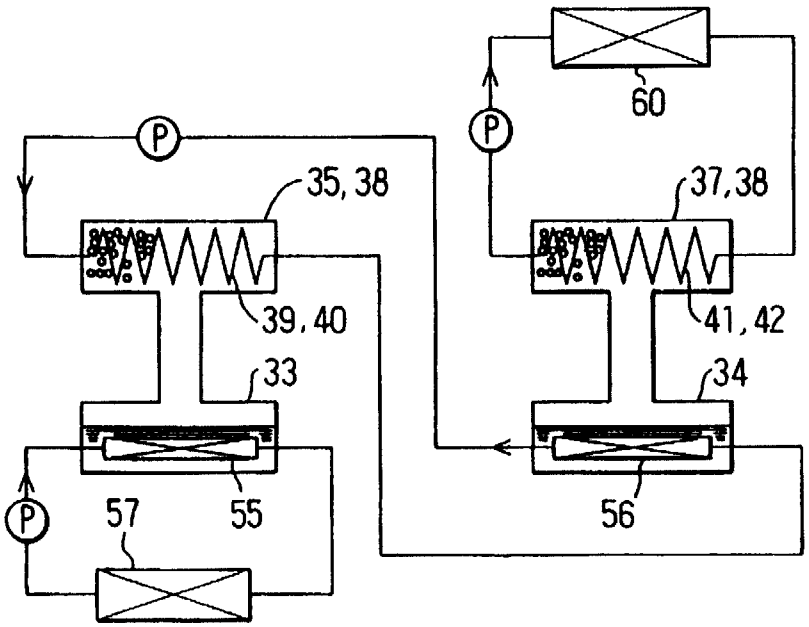
FIG. 23 is a schematic view showing solely a circulation system of coolant fluid in a structural example shown for the purpose of comparison with the present invention.
Figure 24:
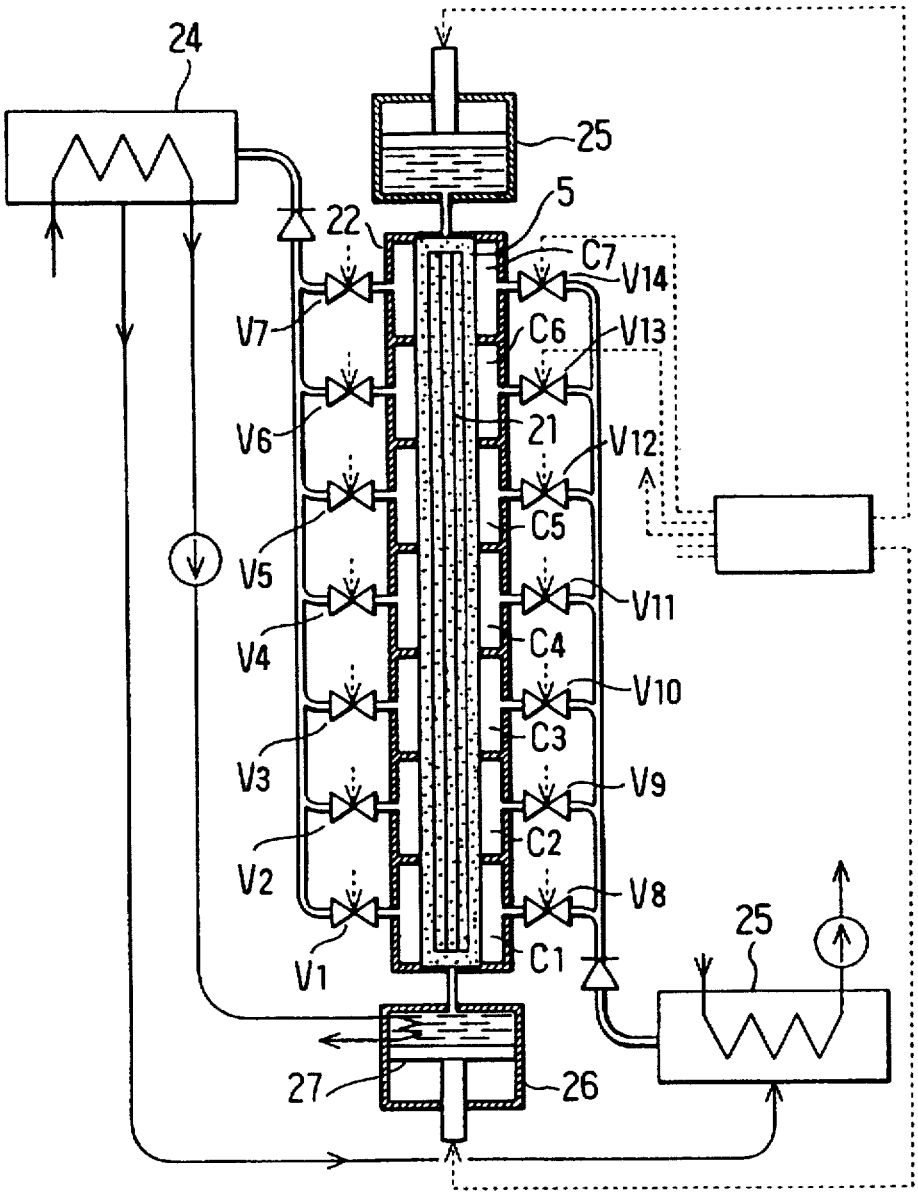
FIG. 24 PRIOR ART
FIG. 24 shows an adsorptive-type refrigeration apparatus according to the prior art.

It may be noted in this connection that, as another structural example to enlarge a differential in adsorption rates of adsorbent S between the adsorption process and the desorption process and improve refrigerant capacity while avoiding large size as was described above, the second stage adsorption devices 37 and 38 may be cooled by coolant fluid cooled by the radiator 60, the first stage adsorption devices 33 and 34 may be cooled by coolant fluid cooled by the second stage evaporator 34, and the cooler for air conditioning use 57 may be cooled by heat exchange refrigerant cooled by the first stage evaporator 33, as shown in FIG. 23.

With this, however, there are three systems of circulation paths to cause coolant fluid and heat exchange refrigerant to be circulated, and because a pump P is necessary for each of the several systems, three pumps are required.

In contrast to this, according to this embodiment the radiator 60 and the second stage evaporator 34 are connected in series, and along with this, the heat exchanging passage 39 of the first first stage adsorption device 35 and the heat exchanging passage 41 of the first second stage adsorption device 37, as well as the heat exchanging passage 40 of the second first stage adsorption device 36 and the heat exchanging passage 42 of the second second stage adsorption device 38, are respectively connected in series, and so there are two systems of circulation paths to cause coolant fluid and heat exchange refrigerant to be circulated, piping structure for coolant fluid and heat exchange refrigerant is simplified, the two pumps 59 and 65 are sufficient, and manufacturing cost can be reduced.

Furthermore, according to this embodiment, in a case where coolant fluid cooled by the radiator 60 and the second stage evaporator 34 flows to the serially connected heat exchanging passages 39 and 41 or heat exchanging passages 40 and 42, the adsorption devices adsorbing refrigerant vapor of lower evaporation temperature, i.e., the heat exchanging passages 39 and 40 of the first stage adsorption devices 35 and 37, are supplied first, cooling adsorbent S thereof, and the adsorption devices adsorbing refrigerant vapor of higher evaporation temperature, i.e., the heat exchanging passages 41 and 42 of the second stage adsorption devices 36 and 38, are supplied thereafter, cooling adsorbent S thereof, and so a heat exchange configuration of one type of opposing flow form is obtained, and adsorbent S can be cooled with favorable efficiency.

Moreover, a temperature differential between the temperature of the refrigerant vapor adsorbed by adsorbent S of the several stages of adsorption devices 35 through 38 and the temperature of the coolant fluid can be made to be mutually equivalent among the adsorption devices 35 through 38. Consequently, the differential between adsorption rate during adsorption by adsorbent S and adsorption rate during desorption by adsorbent S is equivalent in the several stages of adsorption devices 35 through 38, and it becomes possible for each of the several stages of adsorption devices 35 through 38 to supply a large quantity of refrigerant to the condenser 32.

In this connection it may be noted that according to the foregoing first embodiment, the evaporators 33 and 34 and the condenser 32 are discrete devices, and their structure is such that the first stage adsorption devices 35 and 36 and the second stage adsorption devices 37 and 38 adsorb refrigerant vapor evaporated by the evaporators 33 and 34 in the adsorption process and send desorbed refrigerant vapor to the condenser in the desorption process. Because of this, the switching valves 43 through 50 to switch the passages of the refrigerant vapor become necessary, but to alleviate pressure loss these valves must be of large size, and concomitant therewith, large operating force becomes necessary, and so the source of operating power also becomes large in size, which is disadvantageous spatially and in terms of cost.

Figure 5:
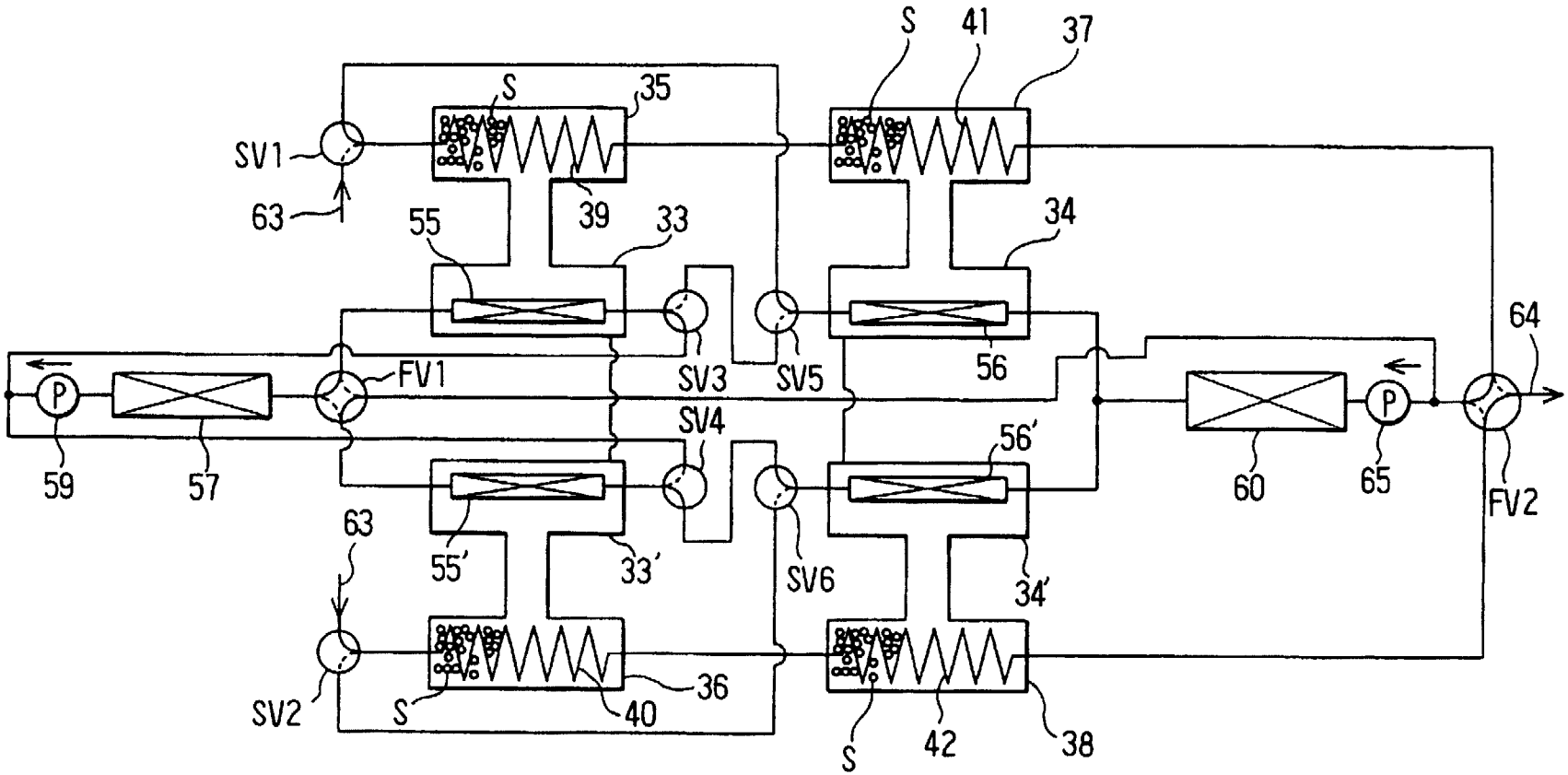
FIG. 5 is a schematic view of a second preferred embodiment of the present invention.

A structural example where this point is improved is shown in FIG. 5 as a second preferred embodiment of this invention. Briefly, the switching valves 43 through 50 to switch the passages of the refrigerant vapor are eliminated in the second embodiment shown in FIG. 5. Because of this, whereas an apparatus according to the above-described first embodiment disposes one first stage evaporator 33 to accommodate the first and second first stage adsorption devices 35 and 36 and one second stage evaporator 34 to accommodate the first and second second stage adsorption devices 37 and 38, an apparatus according to this second embodiment provides one evaporator 33, 33', 34, or 34' doubling in use as a condenser to accommodate respectively each of several adsorption devices 35 through 38.

With this apparatus, when three-way valves SV1 through SV6 and four-way valves FV1 and FV2 are in a state shown by solid lines in FIG. 5, the first first stage and second stage adsorption devices 35 and 37 are in the adsorption process, and the second first stage and second stage adsorption devices 36 and 38 are in the desorption process. At this time, heating fluid flows successively to a heat exchanging passage 40 of the second first stage adsorption device 36 and a heat exchanging passage 42 of the second second stage adsorption device 38, thus heating adsorbent S of the second first stage and second stage adsorption devices 36 and 38, and refrigerant vapor desorbed from adsorbent S because of this flows into the evaporators 33' and 34'.

In contrast thereto, coolant fluid cooled by the radiator 60 is flow divided by heat exchangers 56 and 56' provided respectively within the two second stage evaporators 34 and 34', and coolant fluid shunted to one heat exchanger 56' condenses refrigerant vapor of the evaporator 34' and thereafter flows into a heat exchanger 55' provided within one first stage evaporator 33', condenses refrigerant vapor of the evaporator 33', and returns to the radiator 60. Accordingly, refrigerant liquid condensed by the respective evaporators 33' and 34' is supplied respectively to the evaporators 33 and 34.

Coolant fluid shunted to the other heat exchanger 56 is cooled by the evaporator 34, and thereafter flows successively to the heat exchanging passage 39 of the first first stage adsorption device 35 and the heat exchanging passage 41 of the first second stage adsorption device 37, thus cooling adsorbent S of the first first stage and second stage adsorption devices 35 and 37, and returns to the radiator 60. Because of this, adsorbent S of the respective adsorption devices 35 and 37 adsorbs refrigerant vapor evaporated by the respective evaporators 33 and 34. Accordingly, heat exchange fluid cooled by the heat exchanger 55 is supplied to a cooler 57, and chills air flowing within a vent duct of an air conditioner.

In a case where the three-way valves SV1 through SV6 and the four-way valves FV1 and FV2 have been switched to a state shown by broken lines in FIG. 5, conversely, the first first stage and second stage adsorption devices 35 and 37 perform the desorption process, and the second first stage and second stage adsorption devices 36 and 38 perform the adsorption process; heating fluid, coolant fluid, and paths of passage of the heat exchange medium are similar to those described above, and so detailed description thereof will be omitted.

By employing a structure such as this, refrigerant merely reciprocates among the several evaporators 33, 33', 34, and 34' corresponding to the respective adsorption devices 35 through 38, and so the switching valves 43 through 50 which must be of large size can be omitted. Herein, the number of three-way valves SV1 through SV6 and four-way valves FV1 and FV2 substituting for the omitted switching valves 43 through 50 is greater than in the first embodiment, but because fluid and not steam flows through these valves, they are advantageous spatially and in terms of cost, with no increase in pressure loss even when these valves are not structured to be of large size.

Figure 7:
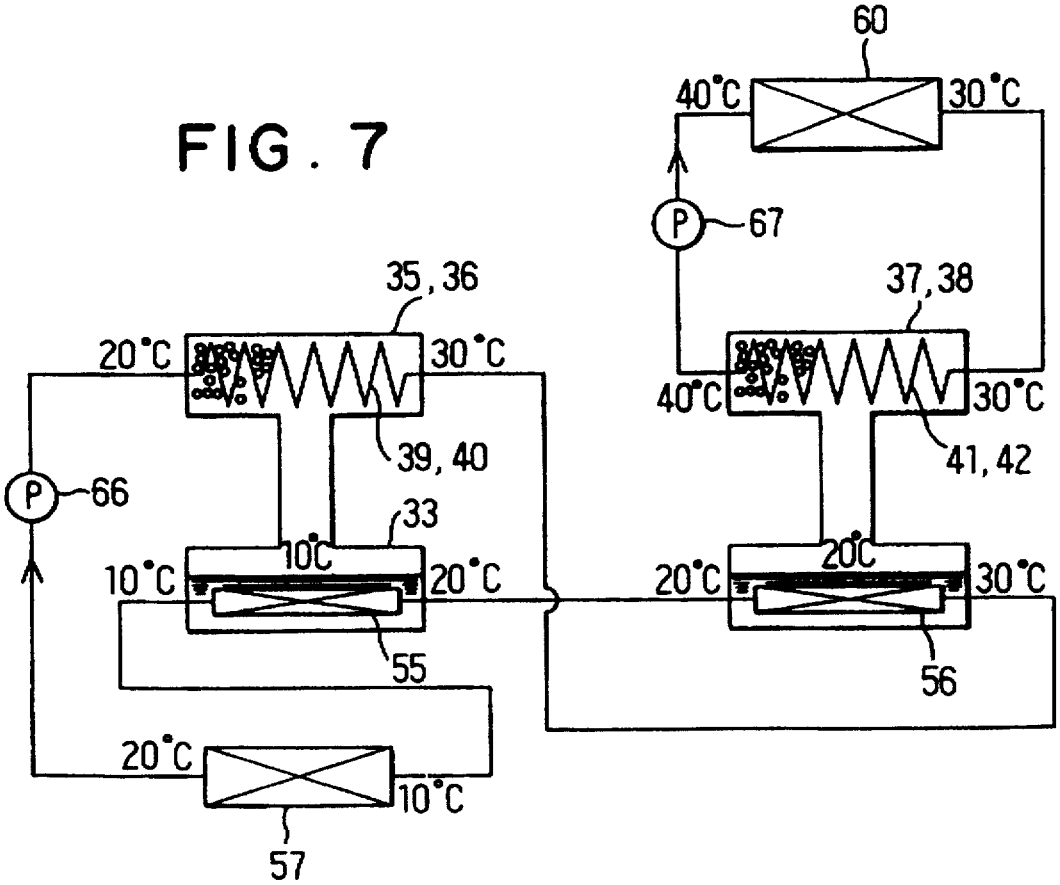
FIG. 7 is a schematic view showing solely a circulation system of coolant fluid in the second embodiment.
Figure 6:
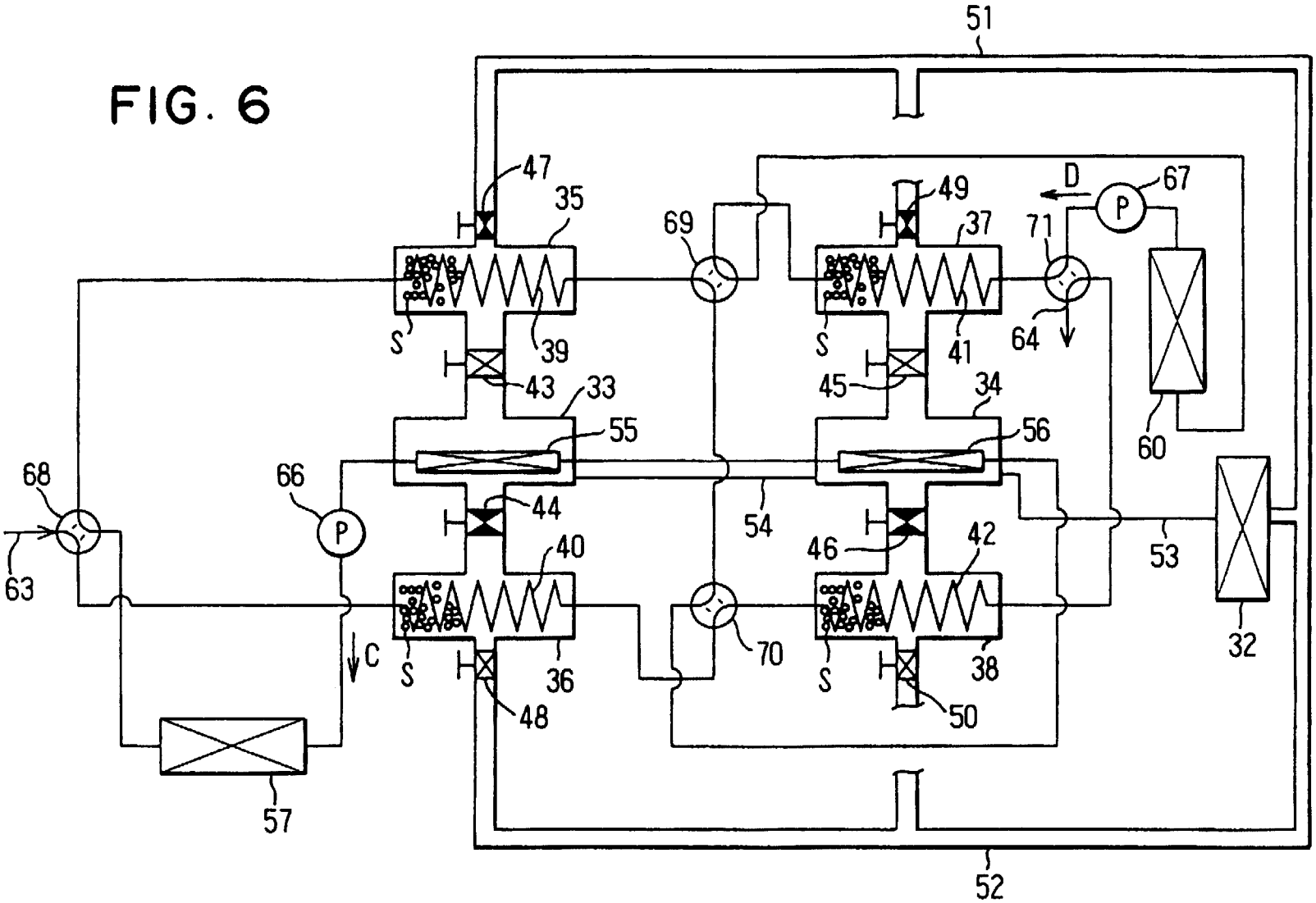
FIG. 6 is a schematic view of a third preferred embodiment of the present invention.

FIG. 6 and FIG. 7 show a third embodiment of this invention. Firstly, characteristics of this third embodiment will be described briefly in comparison with the previously described first embodiment.

First, whereas in the first embodiment the heat exchanging passages 39 and 41 or the heat exchanging passages 40 and 42 are connected in series when performing the adsorption process, in the second embodiment the heat exchanging passages 39 through 42 are independent passage systems.

Second, whereas in the first embodiment the radiator 60 and the second stage evaporator 34 are connected in series to generate coolant fluid, in the second embodiment the radiator 60 is independent, and is employed to generate coolant fluid supplied to the heat exchanging passages 41 and 42 of the second stage adsorption devices 35 and 37.

Third, whereas in the first embodiment the first stage evaporator 33 is employed solely for external area cooling, in the second embodiment the first stage and second stage evaporators 33 and 34 are, in addition to external area cooling use, employed to generate coolant fluid supplied to the heat exchanging passages 39 and 40 of the first stage adsorption devices 35 and 36.

In this embodiment, a heat exchanger 56 of the second stage evaporator 34, a heat exchanger 55 of the first stage evaporator 33, and a cooler for air conditioning use 57 are connected in series, and coolant fluid successively cooled by the heat exchangers 56 and 55 is sent in the direction of arrow C by a pump 66 provided between the heat exchanger 55 and the cooler for air conditioning use 57. Additionally, coolant fluid cooled by the radiator 60 is sent by a pump in the direction of arrow D.

This embodiment is provided with four four-way valves 68 through 71 to switch a supply destination of coolant fluid and heating fluid. Accordingly, when these four-way valves 68 through 71 are in a state shown by solid lines in FIG. 6, coolant fluid successively cooled by the heat exchanger 56 of the second stage evaporator 34 and the heat exchanger 55 of the first stage evaporator 33 chills air blown inside a passenger compartment of the car by the cooler for air conditioning use 57, and thereafter passes successively through the heat exchanging passage 39 of the first first stage adsorption device 35 and the four-way valves 69 and 70 and is returned to the heat exchanger 56 of the second stage evaporator 34.

Coolant fluid cooled by the radiator is sent by the pump 67 in the direction of arrow D passes successively through the four-way valve 71 and the heat exchanging passage 41 of the first second stage adsorption device 37, and is returned to the radiator 60.

Meanwhile, heating fluid discharged from the engine passes successively through a circulation path pipe 63, the four-way valve 68, the heat exchanging passage 40 of the second first stage adsorption device 36, the four-way valve 70, the heat exchanging passage 42 of the second second stage adsorption device 38, the four-way valve 71, and a return path pipe 64, and is returned to the engine.

Consequently, in this state, the first first stage and second stage adsorption devices 35 and 37 perform the adsorption process and the second first stage and second stage adsorption devices 36 and 38 perform the desorption process.

When the four-way valves 68 through 71 are switched to a state shown by broken lines in FIG. 6, coolant fluid cooled successively by the heat exchanger 56 of the second stage evaporator 34 and the heat exchanger 55 of the first stage evaporator 33 chills air blown within the passenger compartment of the car by the cooler for air conditioning use 57, and thereafter passes successively through the four-way valve 68, the heat exchanging passage 40 of the second first stage adsorption device 36, and the four-way valve 70, and is returned to the heat exchanger 56 of the second stage evaporator 34.

Coolant fluid cooled by the radiator 60 is sent in the direction of arrow D by the pump 67, passes successively through the four-way valve 71, the heat exchanging passage 42 of the second second stage adsorption device 38, and the four-way valves 70 and 69, and is returned to the radiator 60.

Meanwhile, heating fluid discharged from the engine passes successively through the circulation path pipe 63, the four-way valve 68, the heat exchanging passage 39 of the first first stage adsorption device 35, the four-way valve 69, the heat exchanging passage 41 of the first second stage adsorption device 37, the four-way valve 71, and the return path pipe 64, and is returned to the engine.

In this state, consequently, the second first stage and second stage adsorption devices 36 and 38 perform the adsorption process and the first first stage and second stage adsorption devices 35 and 37 perform the desorption process.

FIG. 6 shows a state of opening or closure of the switching valves 43 through 50 when the first first stage and second stage adsorption devices 35 and 37 are in the adsorption process and the second first stage and second stage adsorption devices 36 and 38 are in the desorption process. Consequently, when the first first stage and second stage adsorption devices 35 and 37 are in the desorption process and the second first stage and second stage adsorption devices 36 and 38 are in the adsorption process, the switching valves 43 through 50 assume a state of opening or closure which is the opposite of that in FIG. 6.

According to this embodiment, the first stage evaporator 33, in addition to functioning as a device for external area cooling, functions as a device for generating coolant fluid to be supplied to the heat exchanging passages 39 and 40 of the first first stage and second stage adsorption devices 35 and 36, and the second stage evaporator 33, in addition to functioning as a device for external area cooling, functions as a device for generating coolant fluid to be supplied to the heat exchanging passages 39 and 40 of the adsorption devices 35 and 36 of the first stage, which is the prior stage.

For this reason, when the first first stage and second stage adsorption devices 35 and 36 are in the adsorption process, coolant fluid cooled by the first stage and second stage evaporators 33 and 34 is supplied to the heat exchanging passages 39 and 40, and so refrigeration efficiency can be enhanced without leading to larger size, similarly to the first embodiment as was described above. In this connection it may be noted that FIG. 7 shows a passage system solely for coolant fluid, temperatures at various areas thereof, and evaporation temperatures of refrigerant liquid at the evaporators 33 and 34.

According to this embodiment, the heat exchanging passages 39 and 41 and the heat exchange fluids 40 and 42 are mutually independent without being connected in series during supply of coolant fluid, but because the first stage evaporator 33, the second stage evaporator 34, and the cooler for air conditioning use 57 are connected in series, similarly to the first embodiment, two systems of circulation paths are sufficient for supplying coolant fluid, and so piping configuration is simplified, the two pumps 66 and 71 are also sufficient, and manufacturing cost can be reduced.

Figure 8:
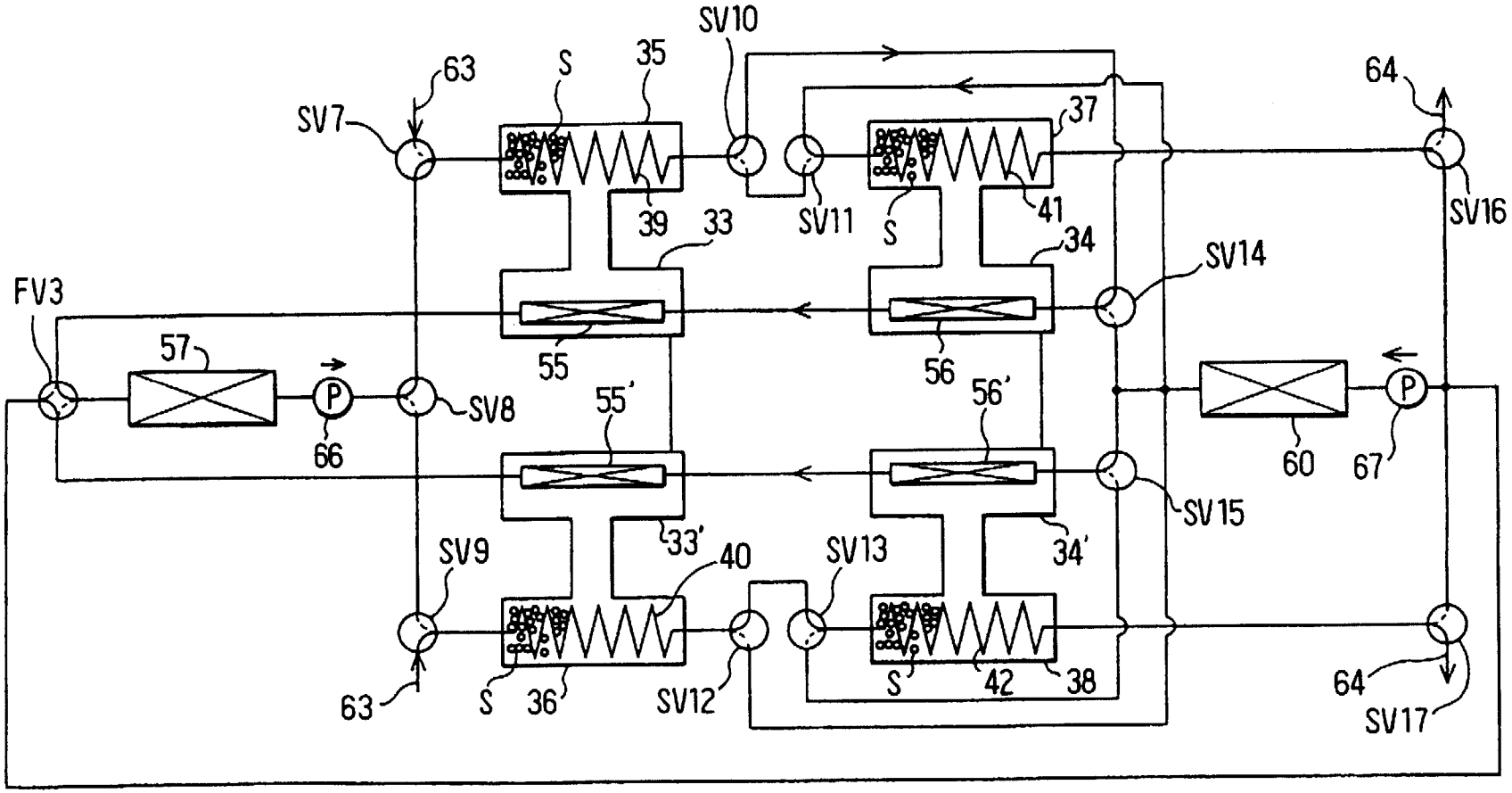
FIG. 8 is a schematic view of a fourth preferred embodiment of the present invention.

FIG. 8 shows a fourth embodiment according to this invention. This fourth embodiment, similarly to the previously described second embodiment and in contrast with the first embodiment, eliminates the switching valves 43 through 50 for switching passages of refrigerant vapor in the third embodiment. That is to say, whereas an apparatus according to the above-described third embodiment disposes one first stage evaporator 33 to accommodate the first and second first stage adsorption devices 35 and 36 and one second stage evaporator 34 to accommodate the first and second second stage adsorption devices 37 and 38, an apparatus according to this fourth embodiment provides one evaporator 33, 33', 34, or 34' doubling in use as a condenser to accommodate respectively each of several adsorption devices 35 through 38.

With this apparatus, when three-way valves SV7 through SV17 and a four-way valve FV3 are in a state shown by solid lines in the drawing, the first first stage and second stage adsorption devices 35 and 37 are in the adsorption process, and the second first stage and second stage adsorption devices 36 and 38 are in the desorption process.

At this time, heating fluid flows successively to a heat exchanging passage 40 of the second first stage adsorption device 36 and a heat exchanging passage 42 of the second second stage adsorption device 38, thus heating adsorbent S of the second first stage and second stage adsorption devices 36 and 38, and refrigerant vapor desorbed from adsorbent S because of this flows into the evaporators 33' and 34'.

In contrast thereto, coolant fluid cooled by the radiator 60 is flow divided to a heat exchanging passage 41 of the first second stage adsorption device 37 and to a heat exchanger 56' provided within one second stage evaporator 34', and coolant fluid shunted to the heat exchanger 56' condenses refrigerant vapor of the evaporator 34', and thereafter flows into a heat exchanger 55' provided within the evaporator 33', condenses refrigerant vapor of the evaporator 33', and returns to the radiator 60. Accordingly, refrigerant liquid condensed by the respective evaporators 33' and 34' is supplied respectively to the evaporators 33 and 34. In addition, coolant fluid shunted to the heat exchanging passage 41 cools adsorbent S of the first second stage adsorption device 37 and returns to the radiator 60. Because of this, adsorbent S of the adsorption device 37 adsorbs refrigerant vapor evaporated in the evaporator 34.

Meanwhile, coolant fluid cooled successively by the heat exchangers 56 and 55 of the evaporators 34 and 33 supplied with refrigerant liquid from the evaporators 34' and 33' firstly is supplied to a cooler 57 to chill air flowing within a vent duct of an air conditioner, and thereafter passes through the heat exchanging passage 39 of the first first stage adsorption device 35 and is returned to the heat exchanging passage 56 of the evaporator 34. Accordingly, adsorbent S of the first first stage adsorption device 35 is cooled by coolant fluid flowing through the heat exchanging passage 39, and adsorbs refrigerant vapor evaporated by the evaporator 33.

In a case where the three-way valves SV7 through SV17 and the four-way valve FV3 have been switched to a state shown by broken lines in FIG. 8, conversely, the first first stage and second stage adsorption devices 35 and 37 perform the desorption process, and the second first stage and second stage adsorption devices 36 and 38 perform the adsorption process; heating fluid, coolant fluid, and paths of passage of the heat exchange medium are similar to those described above, and so detailed description thereof will be omitted.

By employing a structure such as this, the switching valves 43 through 50 which must be of large size shown for the third embodiment can be omitted.

Figure 9:
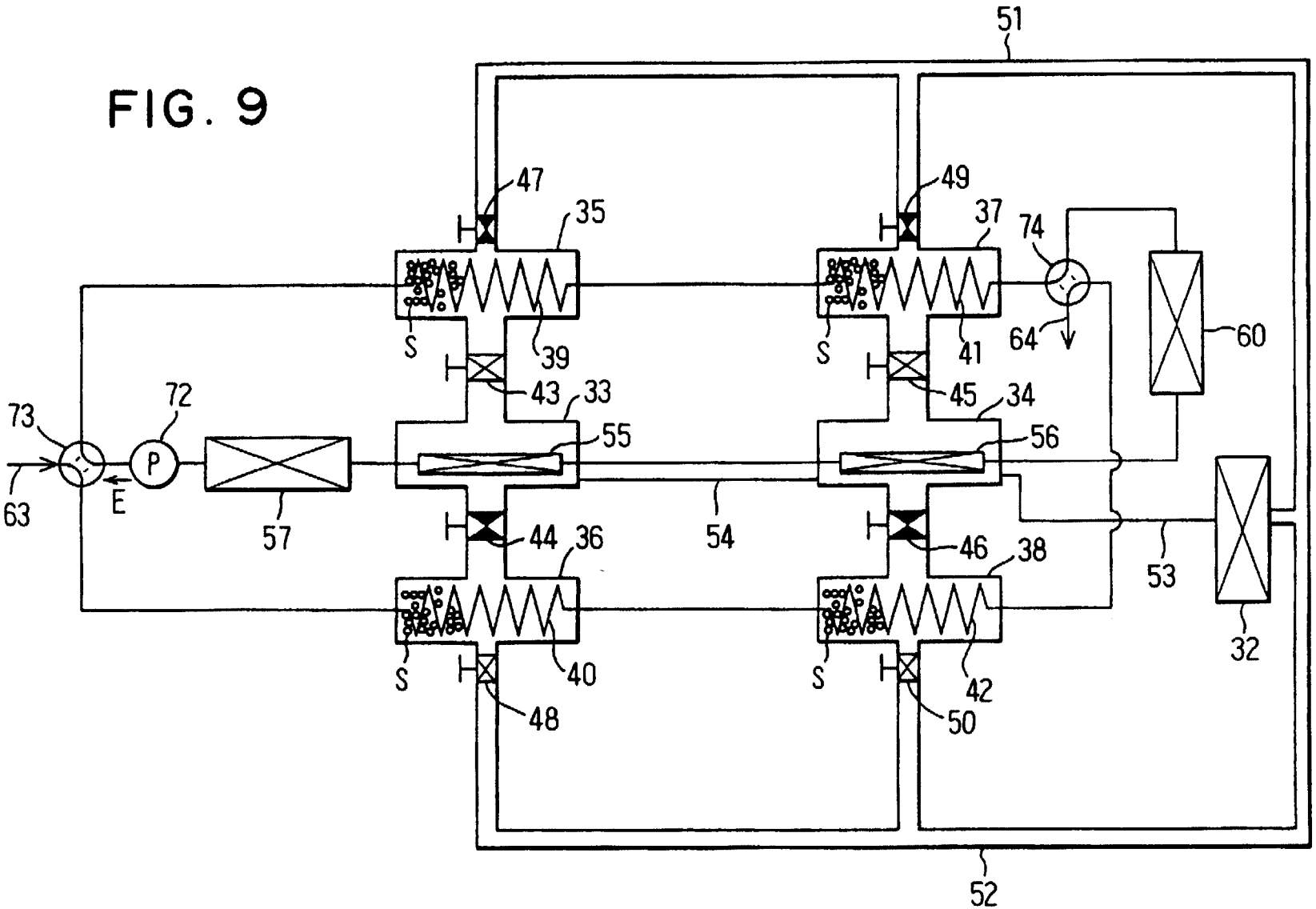
FIG. 9 is a schematic view of a fifth preferred embodiment of the present invention.
Figure 10:
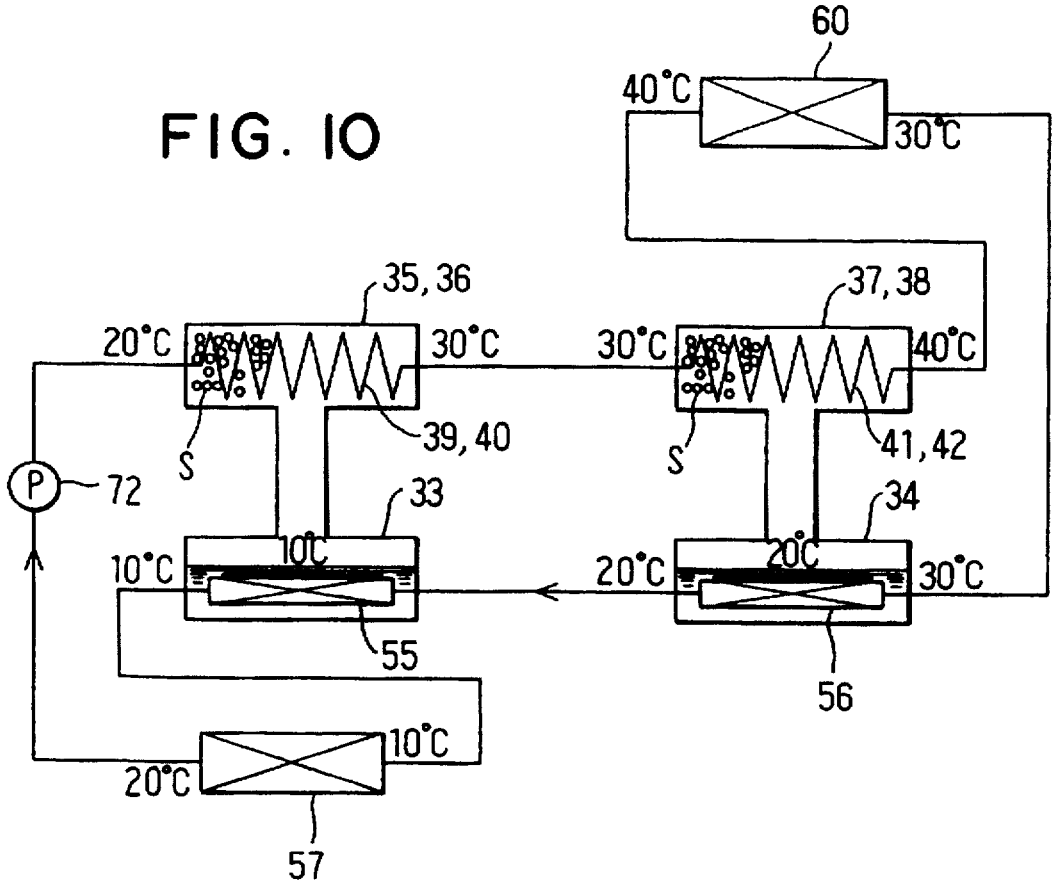
FIG. 10 is a schematic view showing solely a circulation system of coolant fluid in the fifth embodiment.

FIG. 9 and FIG. 10 show a fifth embodiment of this invention. An apparatus according to this embodiment is devised so that a coolant fluid circulation path is made up of only one system. A pair of heat exchanging passages 39 and 41 of first first stage and second stage adsorption devices 35 and 37 and a pair of heat exchanging passages 40 and 42 of second first stage and second stage adsorption devices 36 and 38 are connected in series, and along with this, a radiator 60, a heat exchanger 56 of a second stage evaporator 34, a heat exchanger 55 of a first stage evaporator 33, and a cooler for air conditioning use 57 are connected in series, and a pump 72 to sent coolant fluid in the direction of arrow E is disposed on an outlet side of the cooler for air conditioning use 57.

Two four-way valves 73 and 74 are provided to switch a supply destination of coolant fluid and heating fluid. When these four-way valves 73 and 74 are in a state shown by solid lines in FIG. 9, coolant fluid successively cooled by the radiator 60, the heat exchanger 56 of the second stage evaporator 34, and the heat exchanger 55 of the first stage evaporator 33 chills air blown inside a passenger compartment of the car by the cooler for air conditioning use 57, and thereafter passes successively through the four-way valve 73, the heat exchanging passage 39 of the first first stage adsorption device 35, the heat exchanging passage 41 of the first second stage adsorption device 37, and the four-way valve 74, and is returned to the radiator 60.

Meanwhile, heating fluid discharged from the engine passes successively through a circulation path pipe 63, the four-way valve 73, the heat exchanging passage 40 of the second first stage adsorption device 36, the heat exchanging passage 42 of the second second stage adsorption device 38, the four-way valve 74, and a return path pipe 64, and is returned to the engine.

Consequently, in this state, the first first stage and second stage adsorption devices 35 and 37 perform the adsorption process and the second first stage and second stage adsorption devices 36 and 38 perform the desorption process.

When the four-way valves 73 and 74 are switched to a state shown by broken lines in FIG. 9, coolant fluid cooled successively by the radiator 60, the heat exchanger 56 of the second stage evaporator 34, and the heat exchanger 55 of the first stage evaporator 33 chills air blown within the passenger compartment of the car by the cooler for air conditioning use 57, and thereafter passes successively through the four-way valve 73, the heat exchanging passage 40 of the second first stage adsorption device 36, and the heat exchanging passage 42 of the second second stage adsorption device 38, and is returned to the radiator 60.

Meanwhile, heating fluid discharged from the engine passes successively through the circulation path pipe 63, the four-way valve 73, the heat exchanging passage 39 of the first first stage adsorption device 35, the heat exchanging passage 41 of the first second stage adsorption device 37, the four-way valve 74, and the return path pipe 64, and is returned to the engine.

In this state, consequently, the second first stage and second stage adsorption devices 36 and 38 perform the adsorption process and the first first stage and second stage adsorption devices 35 and 37 perform the desorption process.

FIG. 9 shows a state of opening or closure of switching valves 43 through 50 when the first first stage and second stage adsorption devices 35 and 37 are in the adsorption process and the second first stage and second stage adsorption devices 36 and 38 are in the desorption process. Consequently, when the first first stage and second stage adsorption devices 35 and 37 are in the desorption process and the second first stage and second stage adsorption devices 36 and 38 are in the adsorption process, the switching valves 43 through 50 assume a state of opening or closure which is the opposite of that in FIG. 9.

According to this embodiment, coolant fluid cooled by the radiator 60 is further cooled by the second stage and first stage evaporators 34 and 33 and is supplied to the heat exchanging passages 39 and 41 or 40 and 42, and so refrigerant efficiency can be enhanced without leading to larger size, similarly to the first embodiment as was described above. In this connection it may be noted that FIG. 10 shows a circulation system for coolant fluid, temperatures at various areas thereof, and evaporation temperatures of refrigerant liquid at the evaporators 33 and 34. Furthermore, according to this embodiment, a circulation path of coolant fluid in particular has become a single system, and so coolant fluid piping configuration is further simplified, the one pump 72 suffices, and manufacturing cost can further be reduced.

Figure 11:
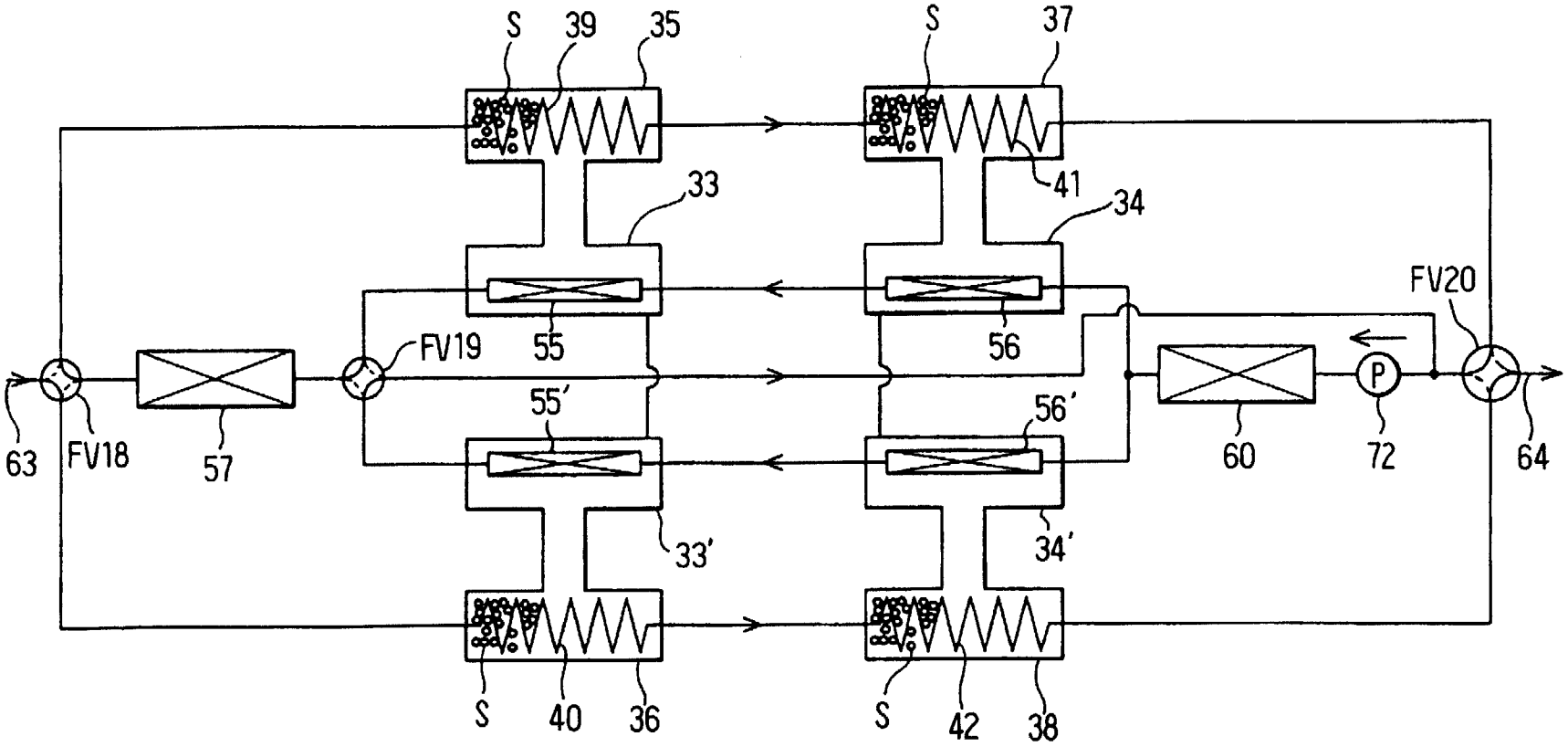
FIG. 11 is a schematic view of a sixth preferred embodiment of the present invention.

FIG. 11 shows a sixth preferred embodiment according to this invention. This sixth embodiment, similarly to the previously described second embodiment and in contrast with the first embodiment, eliminates the switching valves 43 through 50 for switching passages of refrigerant vapor in the fifth embodiment. That is to say, whereas an apparatus according to the above-described fifth embodiment disposes one first stage evaporator 33 to accommodate the first and second first stage adsorption devices 35 and 36 and one second stage evaporator 34 to accommodate the first and second second stage adsorption devices 37 and 38, an apparatus according to this sixth embodiment provides one evaporator 33, 33', 34, or 34' doubling in use as a condenser to accommodate respectively each of several adsorption devices 35 through 38.

With this apparatus, when four-way valves FV18 through FV20 are in a state shown by solid lines in the drawing, the first first stage and second stage adsorption devices 35 and 37 are in the adsorption process, and the second first stage and second stage adsorption devices 36 and 38 are in the desorption process.

At this time, heating fluid flows successively to a heat exchanging passage 40 of the second first stage adsorption device 36 and a heat exchanging passage 42 of the second second stage adsorption device 38, thus heating adsorbent S of the second first stage and second stage adsorption devices 36 and 38, and refrigerant vapor desorbed from adsorbent S because of this flows into the evaporators 33' and 34'.

In contrast thereto, coolant fluid cooled by the radiator 60 is flow divided by heat exchangers 56 and 56' provided respectively within the two second stage evaporators 34 and 34', and coolant fluid shunted to one heat exchanger 56' condenses refrigerant vapor of the evaporator 34', and thereafter flows into a heat exchanger 55' provided within the first stage evaporator 33', condenses refrigerant vapor of the evaporator 33', and returns to the radiator 60. Accordingly, refrigerant liquid condensed by the respective evaporators 33' and 34' is supplied respectively to the evaporators 33 and 34.

Coolant fluid shunted to the other heat exchanger 56 is cooled by the evaporator 34, and thereafter further flows into the heat exchanger 55 of the evaporator 33 and is cooled by the evaporator 33. Thereafter, coolant fluid is supplied to the cooler 57, chills air flowing within a vent duct of an air conditioner, subsequently flows successively to the heat exchanging passage 39 of the first first stage adsorption device 35 and the heat exchanging passage 41 of the first second stage adsorption device 37, thus cooling adsorbent S of the first first stage and second stage adsorption devices 35 and 37, and returns to the radiator 60. Because of this, adsorbent S of the respective adsorption devices 35 and 37 adsorbs refrigerant vapor evaporated by the respective evaporators 33 and 34.

In a case where the four-way valves FV18 through FV20 have been switched to a state shown by broken lines in FIG. 11, conversely, the first first stage and second stage adsorption devices 35 and 37 perform the desorption process, and the second first stage and second stage adsorption devices 36 and 38 perform the adsorption process; heating fluid, coolant fluid, and paths of passage of the heat exchange medium are similar to those described above, and so detailed description thereof will be omitted.

By employing a structure such as this, the switching valves 43 through 50 shown according to the fifth embodiment which must be of large size can be omitted.

Figure 12:
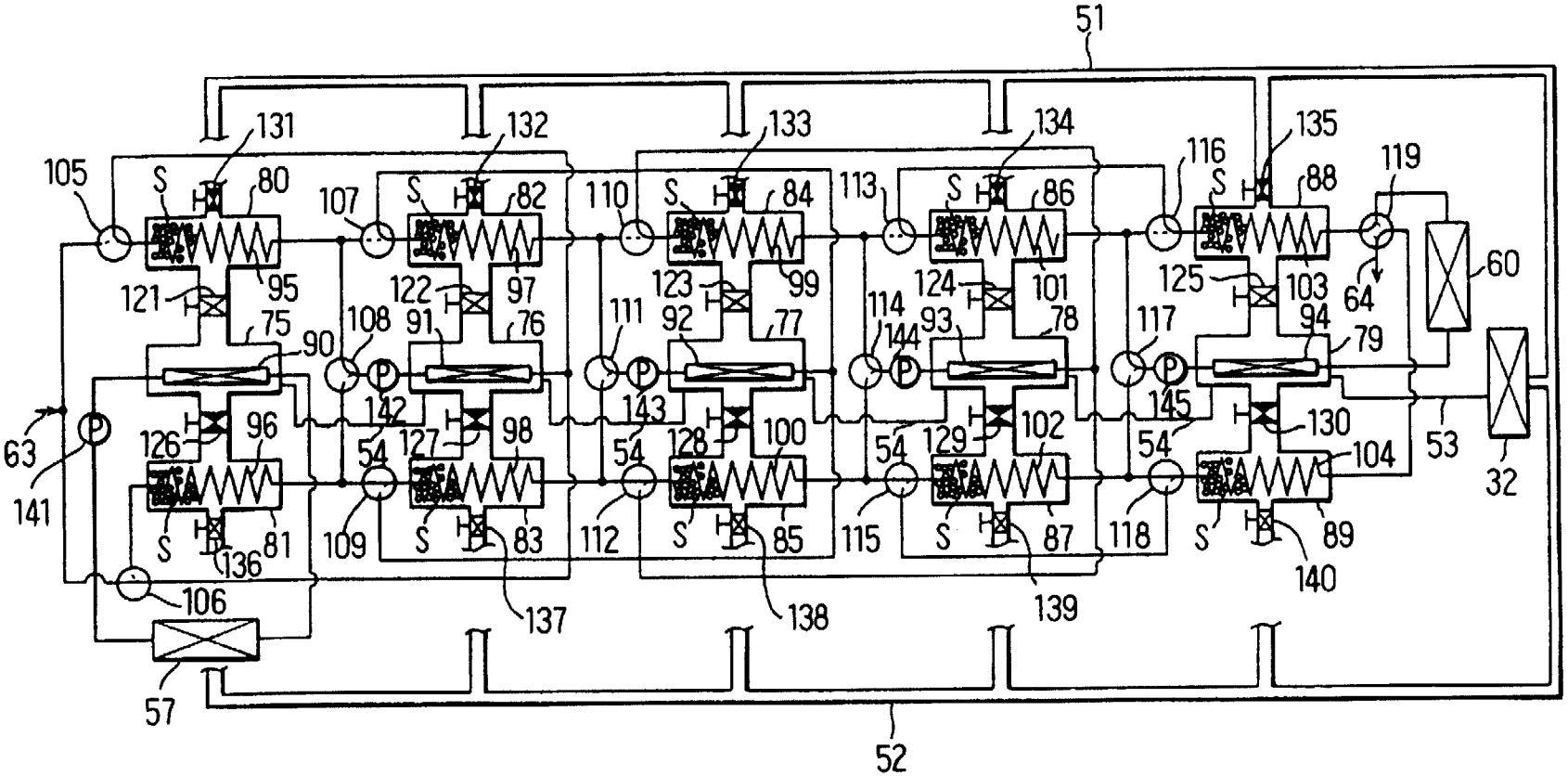
FIG. 12 is a schematic view of a seventh preferred embodiment of the present invention.
Figure 13:
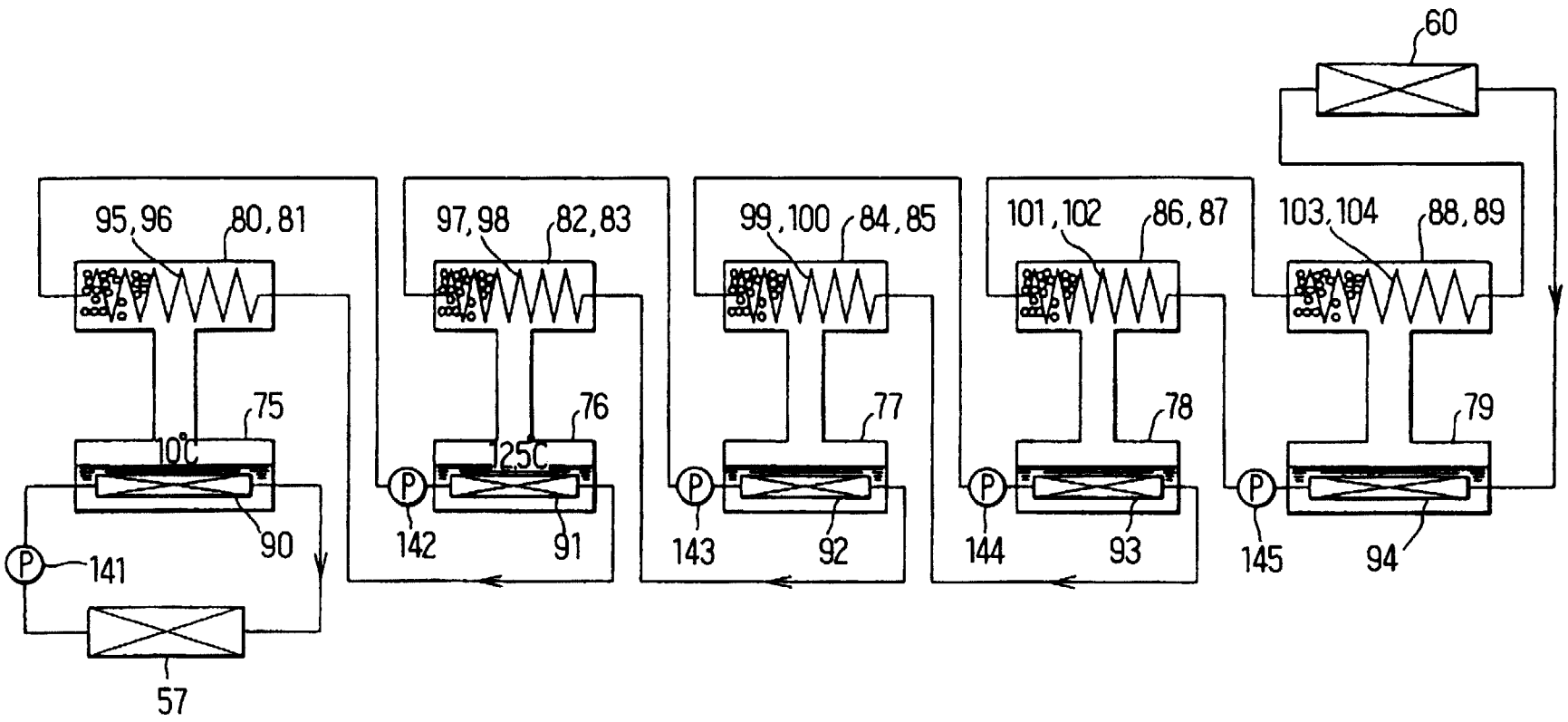
FIG. 13 is a schematic view showing solely a circulation system of coolant fluid in the seventh embodiment.

FIG. 12 and FIG. 13 show a seventh preferred embodiment of this invention. An apparatus according to this embodiment is devised so that a coolant fluid circulation path is made up of only one system. This embodiment is provided with three or more stages, for example, five stages, of evaporators 75 through 79, and five stages of adsorption devices to correspond in a one-to-one relationship with the respective evaporators 75 through 79, and each stage of adsorption device is made up of two (i.e., a first and a second) adsorption devices 80 through 89.

The several stages of evaporators 75 through 79 are mutually connected by capillary piping 54, so that refrigerant fluid supplied from a radiator 60 to the fifth stage evaporator 79 via capillary piping 53 is successively supplied to the prior stages of evaporators 78, 77, 76, and 75 via the capillary piping 54.

The several stages of evaporators 75 through 79 are provided with heat exchangers 90 through 94. Among these, the first stage evaporator 75 is for external area cooling use, and the heat exchanger 90 thereof is connected in series with a cooler for air conditioning use 57. Additionally, the second stage evaporator 76 through the fourth stage evaporator 78 are employed to generate coolant fluid to supply heat exchanging passages 95 through 100 of the respective adsorption devices 80 through 84 of the first stage through the third stage, which are the respective prior stages of the second stage evaporator 76 through the fourth stage evaporator 78. The remaining fifth stage evaporator 79, which is the final stage, cooperates with the radiator 60 and is used to generate coolant fluid to supply heat exchanging passages 101 through 104 of the respective fourth stage and fifth stage adsorption devices 86 through 89.

That is to say, when the first first stage through fifth stage adsorption devices 80, 82, 84, 86, and 88 are in the adsorption process, the second first stage through fifth stage adsorption devices 81, 83, 85, 87, and 89 perform the desorption process. At this time, several three-way valves 105 through 118 and a four-way valve 119 are in a state shown by solid lines in FIG. 12, coolant fluid cooled by the heat exchanger 91 of the second stage evaporator 76 circulates between the heat exchanging passage 95 of the first first stage adsorption device 80 and the heat exchanger 91, coolant fluid cooled by the heat exchanger 92 of the third stage evaporator 77 circulates between the heat exchanging passage 97 of the first second stage adsorption device 82 and the heat exchanger 92, coolant fluid cooled by the heat exchanger 93 of the fourth stage evaporator 78 circulates between the heat exchanging passage 99 of the first third stage adsorption device 84 and the heat exchanger 93, and coolant fluid cooled by the radiator 60 and the heat exchanger 94 of the fifth stage evaporator 79 circulates among the heat exchanging passage 101 of the first fourth stage adsorption device 86, the heat exchanging passage 103 of the first fifth stage adsorption device 88, the radiator 60, and the heat exchanger 94.

Meanwhile, heating fluid is supplied in series to the heat exchanging passages 96, 98, 100, 102, and 104 of the second first stage through fifth stage adsorption devices 81, 83, 85, 87, and 89.

When the several three-way valves 105 through 118 and the four-way valve 119 are switched to a state shown by broken lines in FIG. 12, a state is obtained wherein the first first stage through fifth stage adsorption devices 80, 82, 84, 86, and 88 perform the desorption process, and the second first stage through fifth stage adsorption devices 81, 83, 85, 87, and 89 perform the adsorption process.

When this occurs, coolant fluid cooled by the heat exchanger 91 of the second stage evaporator 76 circulates between the heat exchanging passage 96 of the second first stage adsorption device 81 and the heat exchanger 91, coolant fluid cooled by the heat exchanger 92 of the third stage evaporator 77 circulates between the heat exchanging passage 98 of the second second stage adsorption device 83 and the heat exchanger 92, coolant fluid cooled by the heat exchanger 93 of the fourth stage evaporator 78 circulates between the heat exchanging passage 100 of the second third stage adsorption device 85 and the heat exchanger 93, and coolant fluid cooled by the radiator 60 and the heat exchanger 94 of the fifth stage evaporator 79 circulates between the heat exchanging passage 102 of the second fourth stage adsorption device 87, the heat exchanging passage 104 of the second fifth stage adsorption device 89, the radiator 60, and the heat exchanger 94.

Meanwhile, heating fluid is supplied in series to the heat exchanging passages 95, 97, 99, 101, and 103 of the first first stage through fifth stage adsorption devices 80, 82, 84, 86, and 88.

Switching valves 121 through 140 to open and close inlets and outlets of the several adsorption devices 86 through 95 indicate, in FIG. 12, a state of opening and closure wherein the first first stage through fifth stage adsorption devices 80, 82, 84, 86, and 88 perform the adsorption process and the second first stage through fifth stage adsorption devices 81, 83, 85, 87, and 89 perform the desorption process.

According to this embodiment, coolant fluid is cooled to 30° C. by the radiator 60, and meanwhile a difference in evaporation temperature of refrigerant liquid between two sets of mutually adjacent evaporators is reduced in a case where evaporation temperature of refrigerant liquid of the first stage evaporator 75 is 10° C.

Because of this, for example, refrigerant vapor vaporized at 10° C. by the first stage evaporator 75 cools adsorbent S in the first stage adsorption devices 80 and 81 with coolant fluid cooled by the second stage evaporator 76 of a vaporization temperature which does not differ excessively from this 10° C. Such a relationship is similarly established also in the relationships of coolant fluid cooled by the second stage adsorption devices 82 and 83 and the third stage evaporator 77, coolant fluid cooled by the third stage adsorption devices 84 and 85 and the fourth stage evaporator 78, and coolant fluid cooled by the fourth stage and fifth stage adsorption devices 86 and 87, and 88 and 89, the radiator 60, and the fifth stage evaporator 79. Consequently, because adsorbent S of the several stages of adsorption devices is cooled to a yet lower temperature and a differential with the temperature of refrigerant vapor is reduced, a larger amount of refrigerant is adsorbed and chilling capacity of the adsorptive-type refrigeration apparatus overall is further enhanced, as is understood from FIG. 4.

Also, the heat exchanging passages 101 and 102 of the fourth stage adsorption devices 86 and 87 and the heat exchanging passages 103 and 104 of the fifth stage adsorption devices 88 and 89 are connected in series, and so even as the adsorption devices have five stages, four systems of circulation paths are sufficient for coolant fluid thereof, and so piping configuration is simplified. Furthermore, pumps 141 through 145 to send coolant fluid also suffice with only five units, including one for the cooler for air conditioning use 57, and manufacturing cost can be held to a low level. The coolant fluid circulation path is shown in FIG. 13.

Figure 14:
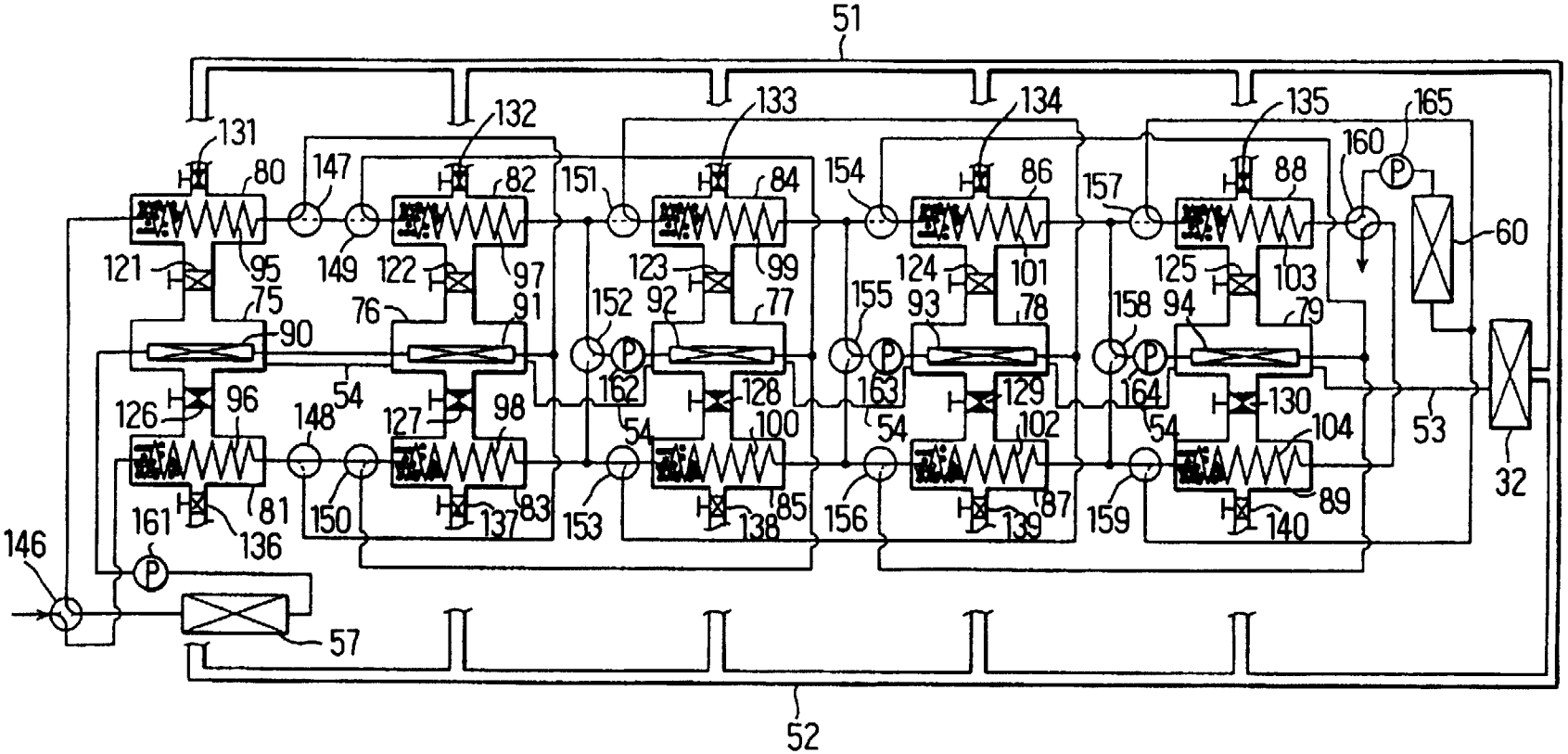
FIG. 14 is a schematic view of an eighth preferred embodiment of the present invention.
Figure 15:
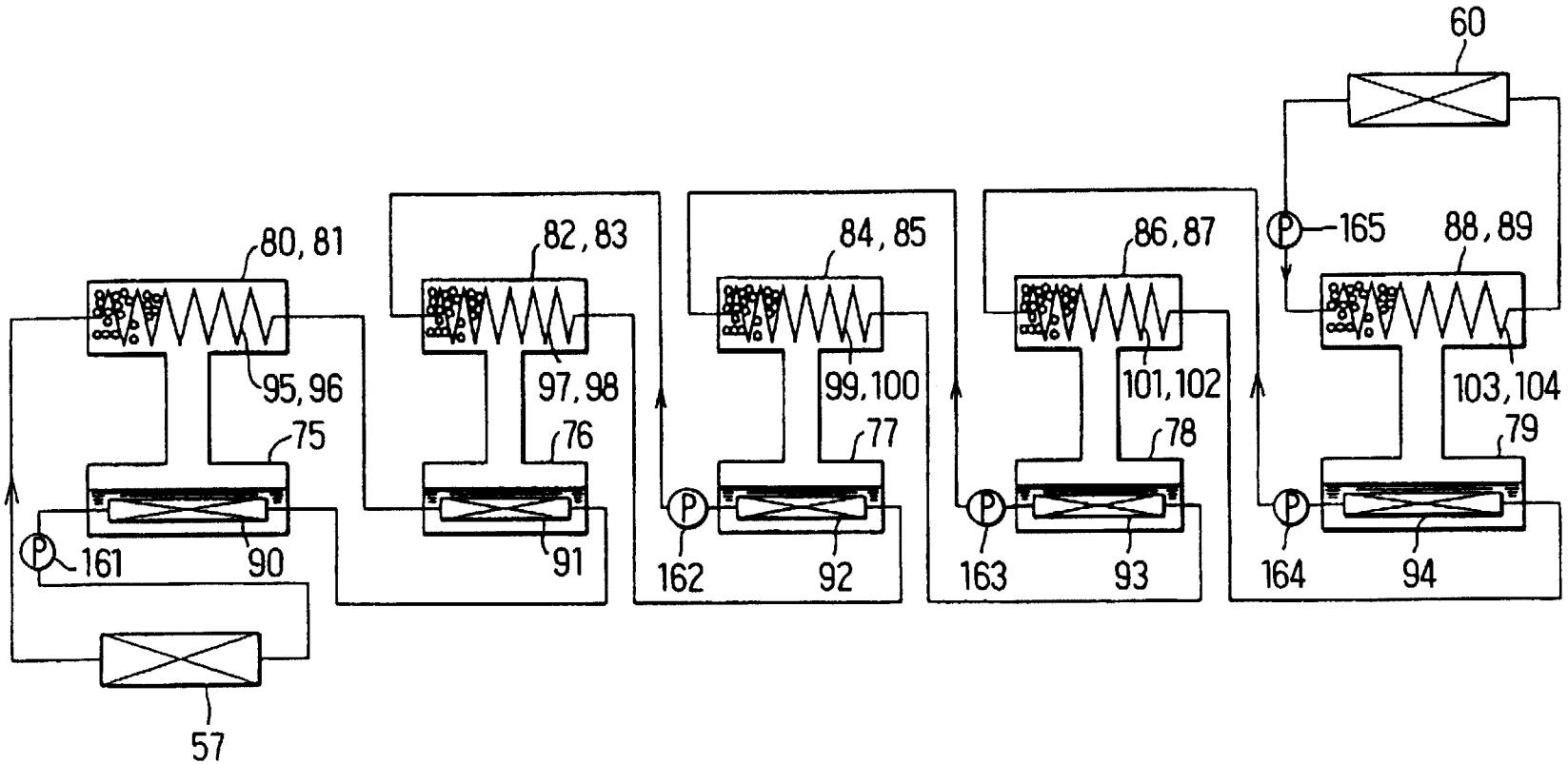
FIG. 15 is a schematic view showing solely a circulation system of coolant fluid in the eighth embodiment.

FIG. 14 and FIG. 15 show an eighth preferred embodiment of this invention. An apparatus according to this embodiment is devised so that first stage and second stage evaporators 75 and 76 are used for external area cooling and for generating coolant fluid supplied to heat exchanging passages 95 and 96 of first stage adsorption devices 80 and 81, a fifth stage evaporator 79 is used for generating coolant fluid supplied to heat exchanging passages 101 and 102 of adsorption devices 86 and 87 of a fourth stage, which is the prior stage, and a radiator 60 is used for generating coolant fluid supplied to heat exchanging passages 103 and 104 of fifth stage adsorption devices 88 and 89.

Accordingly, when first first stage through fifth stage adsorption devices 80, 82, 84, 86, and 88 perform the adsorption process and second first stage through fifth stage adsorption devices 81, 83, 85, 87, and 89 perform the desorption process, four-way valves 146 and 160 and three-way valve 147 through 159 are in a state shown by solid lines, and coolant fluid successively cooled by heat exchangers 91 and 90 of the first stage and second stage evaporators 75 and 76 circulates among a cooler for air conditioning use 57, heat exchanging passages 95 and 97 of the first first stage and second stage adsorption devices 80 and 82, and the heat exchangers 91 and 90; coolant fluid cooled by a heat exchanger 92 of a third stage evaporator 77 is circulated between a heat exchanging passage 97 of the first second stage adsorption device 82 and the heat exchanger 92; coolant fluid cooled by a heat exchanger 93 of a fourth stage evaporator 78 is circulated between a heat exchanging passage 99 of the first third stage adsorption device 84 and the heat exchanger 93; coolant fluid cooled by a heat exchanger 94 of a fifth stage evaporator 79 is circulated between a heat exchanging passage 101 of the first fourth stage adsorption device 86 and the heat exchanger 94; and coolant fluid cooled by the radiator 60 is circulated between a heat exchanging passage 103 of the first fifth stage adsorption device 88 and the radiator 60.

Meanwhile, heating fluid is supplied in series to the heat exchanging passages 96, 98, 100, 102, and 104 of the second first stage through fifth stage adsorption devices 81, 83, 85, 87, and 89.

When the three-way valves 146 and 160 and the four-way valves 147 through 159 are switched to a state shown by broken lines in the drawing, a state is obtained wherein the first first stage through fifth stage adsorption devices 80, 82, 84, 86, and 88 perform the desorption process, and the second first stage through fifth stage adsorption devices 81, 83, 85, 87, and 89 perform the adsorption process.

When this occurs, coolant fluid cooled by the heat exchangers 91 and 90 of the second stage and first stage evaporators 76 and 75 circulates among the cooler for air conditioning use 57, the heat exchanging passages 96 and 98 of the second first stage and second stage adsorption devices 81 and 83, and the heat exchangers 91 and 91; coolant fluid cooled by the heat exchanger 92 of the third stage evaporator 77 is circulated between the heat exchanging passage 98 of the second second stage adsorption device 83 and the heat exchanger 92; coolant fluid cooled by the heat exchanger 93 of the fourth stage evaporator 78 is circulated between the heat exchanging passage 100 of the second third stage adsorption device 85 and the heat exchanger 93; coolant fluid cooled by the heat exchanger 94 of the fifth stage evaporator 79 is circulated between the heat exchanging passage 102 of the second fourth stage adsorption device 87 and the heat exchanger 94; and coolant fluid cooled by the radiator 60 is circulated between the heat exchanging passage 104 of the second fifth stage adsorption device 89 and the radiator 60.

Meanwhile, heating fluid is supplied in series to the heat exchanging passages 95, 97, 99, 101, and 103 of the second first stage through fifth stage adsorption devices 80, 82, 84, 86, and 88.

As shown in FIG. 15, circulation paths for coolant fluid are five systems even when structured in this way, and so pumps 161 through 165 also suffice with only five units, and effects similar to the above-described seventh embodiment can be obtained.

Figure 16:
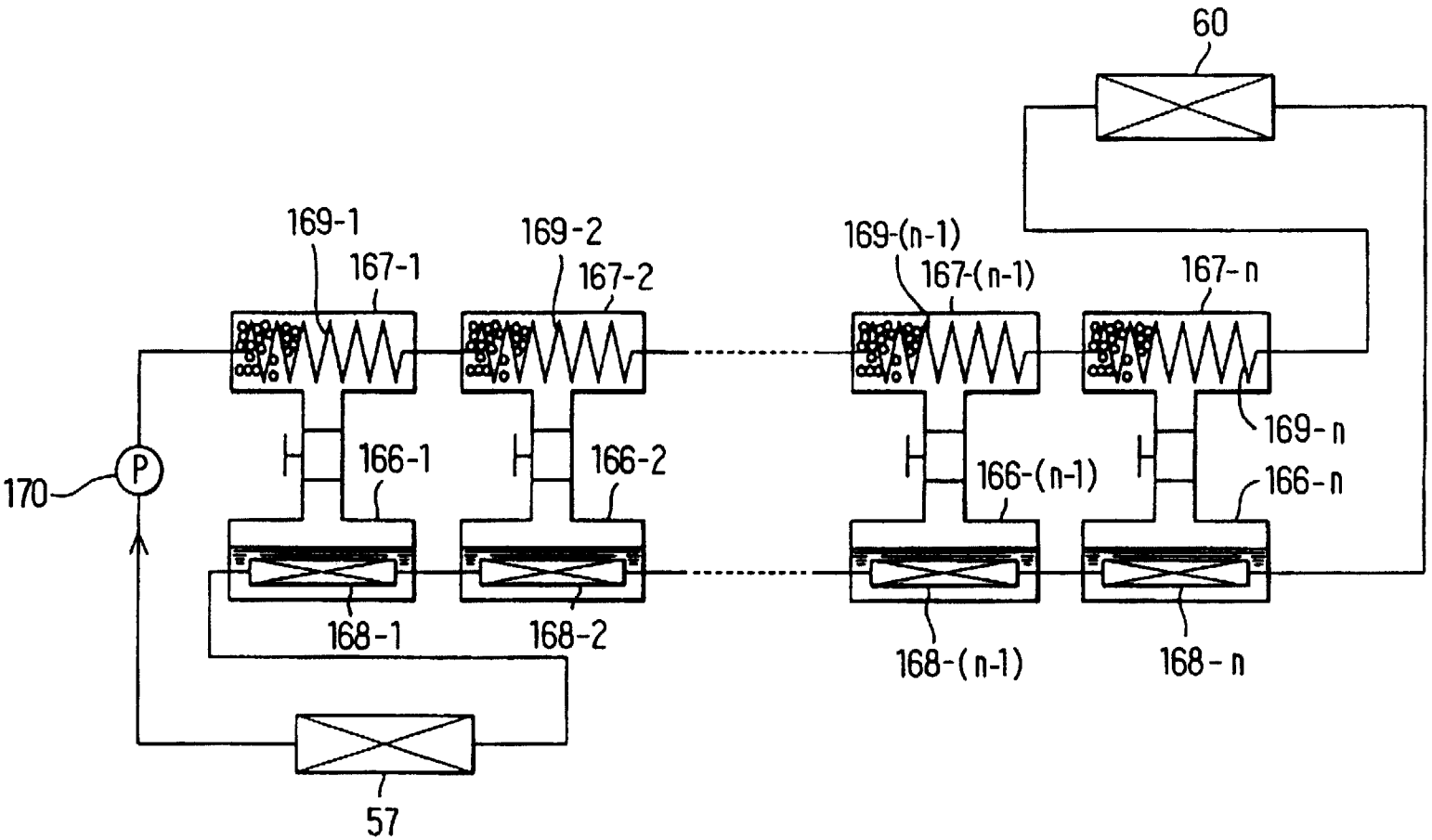
FIG. 16 is a schematic view showing solely a circulation system of coolant fluid in a ninth preferred embodiment of the present invention.

FIG. 16 shows a ninth preferred embodiment of this invention. This apparatus disposes multiple stages of evaporators 166-1 through 166-n and adsorption devices 167-1 through 167-n, and connects in series a radiator 60, heat exchangers 168-1 through 168-n of the stages of evaporators 166-1 through 166-n, and a cooler for air conditioning use 57, and along with this, connects in series heat exchanging passages 169-1 through 169-n of the stages of adsorption devices 167-1 through 167-n. When performing the adsorption process, heating fluid is supplied in series to the heat exchanging passages 169-1 through 169-n of the several stages of adsorption devices 167-1 through 167-n. When performing the desorption process, coolant fluid cooled by the radiator 60 is successively cooled by heat exchangers of evaporators on a prior stage side of the heat exchanger 168-n of the final stage evaporator 166-n, and firstly the cooler for air conditioning use 57 is cooled by coolant fluid discharged from the heat exchanger 168-1 of the first stage evaporator 166-1, and thereafter coolant fluid is recirculated to flow from the heat exchanging passage 169-1 of the first stage adsorption device 167-1 to the heat exchanging passage of the adsorption device of successively later stages, and be returned to the radiator 60.

When evaporators and adsorption devices of a multiplicity of stages are provided in this way, coolant fluid which has been cooled to 30° C. by the radiator 60 is improved when cooled to 10° C. by the time the heat exchanger 168-n of the first stage evaporator 166-1 is reached, and so it is sufficient if vaporization temperature of refrigerant liquid is slightly lower than 30° C. at the final stage evaporator 166-n, and thereafter becomes lower a little at a time while moving to evaporators of progressively earlier stages, and so a temperature difference between refrigerant vapor adsorbed at the several stages of adsorption devices and adsorbent S is further reduced.

For example, because refrigerant vapor of a temperature slightly lower than 30° C. is cooled by coolant fluid of a temperature slightly lower than 40° C. at the final stage adsorption device 167-n, an adsorption rate of approximately 30% is yielded, as shown by point P5 in FIG. 4; because refrigerant vapor of a temperature slightly lower than 10° C. is cooled by coolant fluid of about 20° C. at the first stage adsorption device 167-1, an adsorption rate of approximately 28% is yielded, as shown by point P6 in FIG. 4. As is understood from the foregoing, cooling capacity can be further heightened by providing evaporators and adsorption devices in a multiplicity of stages.

Additionally, according to this embodiment, the circulation path for coolant fluid is solely one system, and so piping configuration for the circulation path for coolant fluid becomes simpler, and along with this, a single pump 170 is sufficient for sending coolant fluid, and reduction of manufacturing cost can be realized.

To achieve compactness of an adsorption device in the several embodiments described hereinabove, it may be appropriate to give consideration to the adsorbent S.

Figure 17:
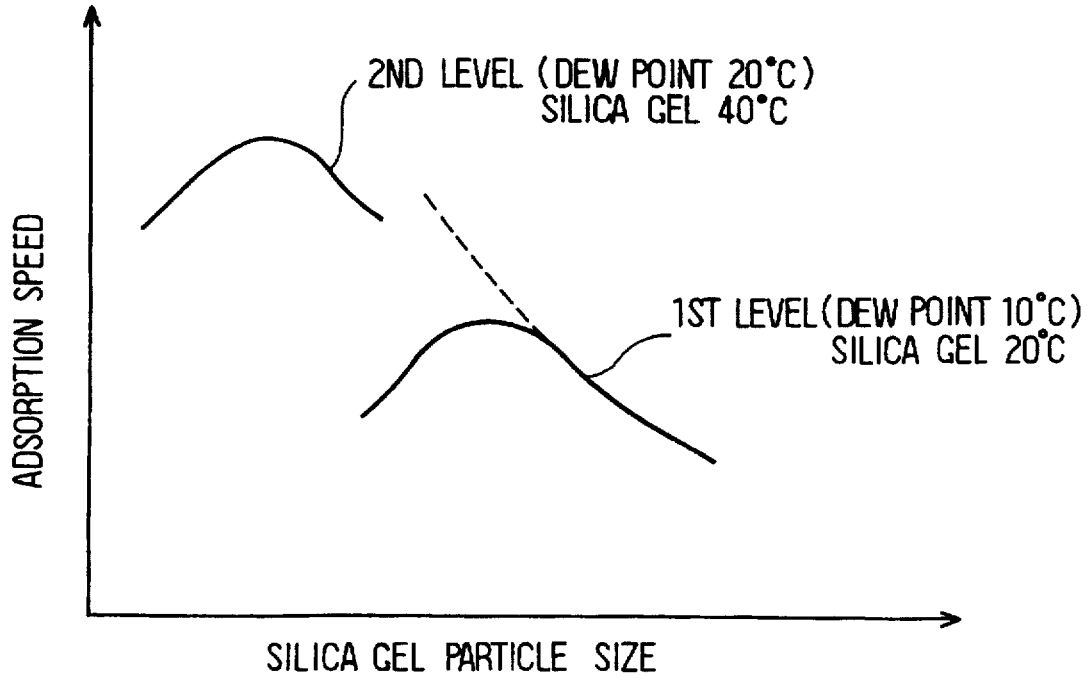
FIG. 17 is a graph showing a relationship between adsorbent particle size and adsorption speed in embodiments of the invention.

FIG. 17 shows, in a case where silica gel has been used as adsorbent S, a relationship between particle size and adsorbing speed thereof for the first stage adsorption device and the second stage adsorption device. As is understood from FIG. 17, adsorbing speed of adsorbent S increases as refrigerant vapor pressure (temperature) grows higher, even at identical relative humidity. In a case of this invention provided with a plurality of stages of adsorption devices, evaporation temperature (evaporation pressure) of refrigerant becomes increasingly higher at successively later stages. Because of this, compactness of the adsorption device can be achieved by reducing the filled quantity of adsorbent S in the several stages of adsorption devices at increasingly later stages among the plurality of stages of adsorption devices, and moreover there is no danger of loss in adsorption capacity of refrigerant by adsorbent S even when such compactness is realized.

Additionally, because surface area per unit weight increases as particle size of adsorbent S becomes smaller, adsorption speed of refrigerant vapor becomes faster, as shown in FIG. 17. However, the ability of the refrigerant vapor to penetrate within the adsorbent S layer becomes poorer as particle size grows smaller. Ideal particle size of adsorbent S is determined by superposition of these two conditions. At this time, as was described above, adsorbing speed of adsorbent S increases as evaporation pressure of the refrigerant increases, even at identical relative humidity, and so it is sufficient to cause particle size of adsorbent to become increasingly smaller in adsorption devices of successively later stages, where pressure of refrigerant vapor is high.

In light of the above, it is sufficient to reduce the filled quantity of adsorbent S in the several stages of adsorption devices at increasingly later stages, and moreover to cause particle size to become increasingly smaller in adsorption devices of successively later stages, without using identical particle size for the several stages of adsorption devices. Compactness of the adsorption device can be realized by doing this, and there is no chance of adsorbing speed or adsorption quantity of adsorbent S being reduced by doing this.

In an automotive air conditioner, there may be cases where it is desirable to chill air blown within a vent duct by a cooler for air conditioning use 57 to around 0° C. For example, to prevent fogging of the inner surface of the windshield during dehumidification and heating of the interior of a passenger compartment in winter, it is necessary to chill the air to around 0° C., and perform dehumidification until the condensation point of conditioned air blown against the windshield becomes about the same as ambient air temperature.

To chill air to around 0° C. by the cooler for air conditioning use 57 in this way, for example in FIG. 16, the evaporation temperature of refrigerant of the first stage evaporator 166-1 must be made to be approximately −5° C. When distilled water has been used as the refrigerant, however, the refrigerant freezes at such low temperatures. To avoid this, it is sufficient to use water to which a gelation point lowering agent has been compounded, but if the amount of added gelation point lowering agent is excessive, problems may occur such as a drop in refrigeration (cooling) capacity with an alcohol-base agent, or corrosion of the circulation path of the refrigerant with a saline agent.

In this regard, two adsorption devices connecting an evaporator doubling in use as a condenser are provided in a plurality of stages, such as in the structure shown for the second embodiment in FIG. 5, a structure is employed to independently seal refrigerant within each of the several stages, and among these several stages, water compounded with a gelation point lowering agent is employed as refrigerant in a required stage of a forward stage side, namely a stage whereat evaporation temperature of refrigerant becomes 0° C. or less. When this is done, refrigerant with a gelation point lowering agent intermixed therewithin is not at all stages but is restricted solely to necessary stages, and so a problem of a decline in refrigeration (cooling) capacity is avoided to the greatest extent possible, and along with this, a range in which there exists a chance of occurrence of corrosion or the like can be restricted to a small range.

In this case, a required stage on a forward stage side employs an alcohol-based substance, for example ethanol, as refrigerant, and employs activated carbon as adsorbent S. Freezing of the refrigerant can reliably be prevented because the temperature at which the alcohol-based substance freezes is low, and because the activated carbon readily adsorbs the alcohol-based substance, a small quantity of adsorbent S can adsorb a large quantity of the alcohol-based substance, and compactness of the adsorption device can be realized.

Figure 18:
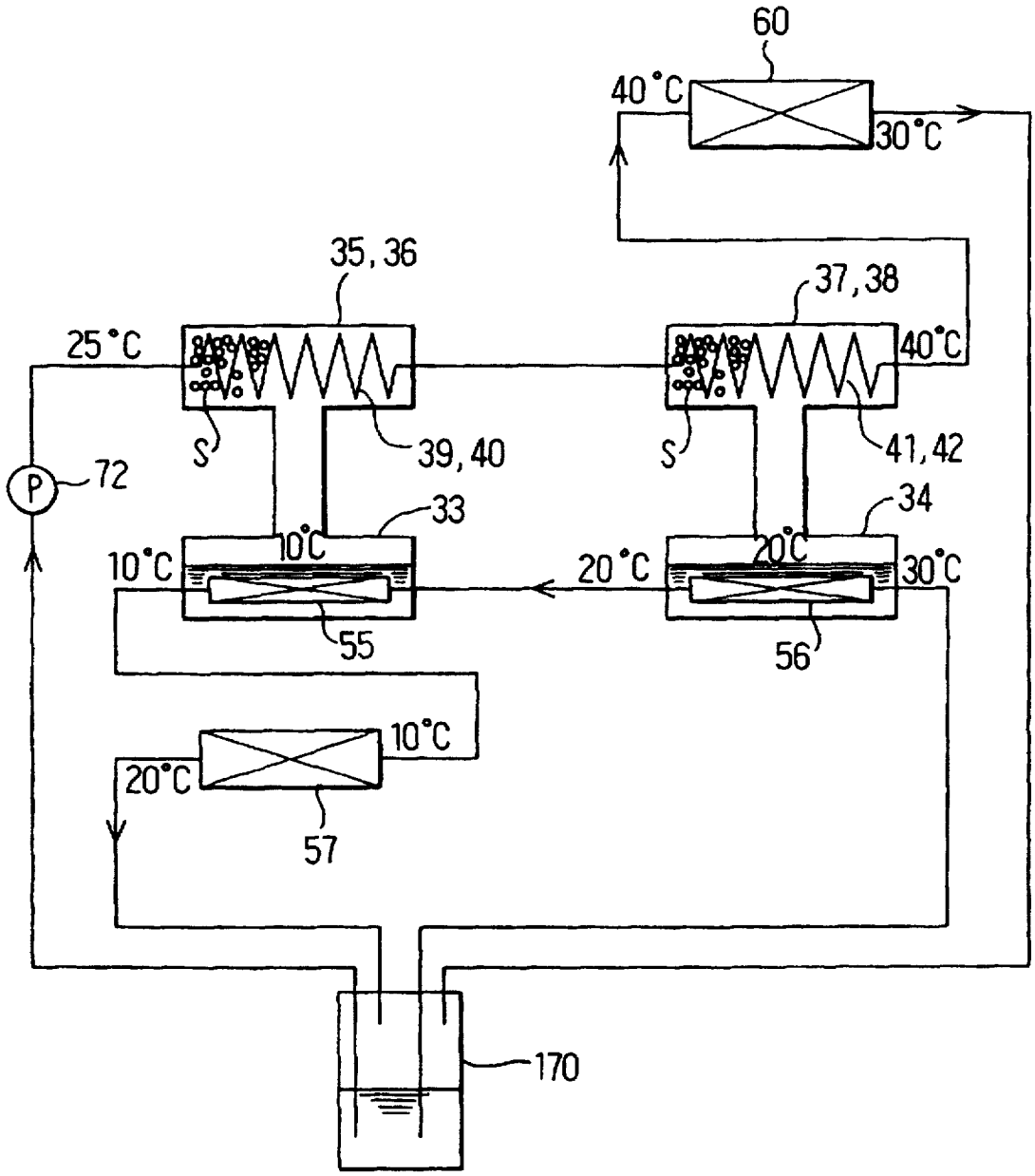
FIG. 18 shows a tenth preferred embodiment of the present invention.

According to this invention, among the plurality of stages of adsorption devices coolant fluid flows from an adsorption device having an evaporation temperature on a low side to a heat exchanger of an adsorption device having a evaporation temperature on a high side, and so a heat exchange configuration of one type of opposing flow form is obtained. To boost heat exchange efficiency of this opposing flow heat exchanger, a structure such as that of a tenth embodiment according to this invention as shown in FIG. 18 may be employed. The basic structure of the refrigeration apparatus according to this tenth embodiment is identical to the fifth embodiment shown in FIGS. 9 and 10.

An inlet of a radiator 60 and an outlet of a cooler for air conditioning use 57 are connected to a mixing tank 170, and coolant fluid discharged from the radiator 60 and the cooler for air conditioning use 57 is intermixed in this mixing tank 170. Two outlets are provided on this mixing tank. One outlet is connected to a heat exchanger 56 of a second stage evaporator 34, which is the final stage evaporator, and the other outlet is connected to an intake port of a pump 72.

In a case of structure such as this, coolant fluid discharged from the outlet of the radiator 60 and coolant fluid discharged from the outlet of the cooler for air conditioning use 57 are intermixed within the mixing tank 170 and coolant fluid subsequently to this mixing is supplied to the heat exchanger 56 of the second stage evaporator 34, and together with this, is supplied to a heat exchanging passage 39 of a first first stage adsorption device 35 or to a heat exchanging passage 40 of a second first stage adsorption device 36. Heat exchange efficiency is enhanced by doing this.

Capacity as a refrigeration device is determined by amount of absorbed heat of the cooler for air conditioning use 57 and amount of absorbed heat Qc thereof is:

Qc=Gb*Cpb*(Tco−Tci).

Here,

Gb=coolant-fluid flow per unit time;

Cpb=specific heat of coolant fluid;

Tci=coolant fluid temperature at the inlet of the cooler for air conditioning use 57; and Tco=coolant fluid temperature at the outlet of the cooler for air conditioning use 57.

Meanwhile, amount of heat Qs radiated by adsorbent S during adsorption of refrigerant is:

Qs=Gb*Cpb*(Texo−Texi).

Here,

Texi=coolant fluid temperature at the inlets of the heat exchanging passages 39 and 40 of the first stage adsorption device; and Texo=coolant fluid temperature at the outlets of the heat exchanging passages 41 and 42 of the second stage adsorption device.

Because amount of radiated heat Qs during adsorption and amount of required heat Qd during desorption by adsorbent S are believed to be identical, Qs=Qd. Accordingly, efficiency <ETA> of the opposing flow heat exchanger is:

$$\langle ETA\rangle = Qc/Qd = Qc/Qs =$$

$$(Gb * Cpb * [Tco - Tci])/(Gb * Cpb * [Texo - Texi]) =$$

$$(Tco - Tci)/(Texo - Texi).$$

Accordingly, as shown in FIG. 10, in a case where the mixing tank 170 is not provided:

coolant fluid temperature at the inlet of the cooler for air conditioning use 57 Tci is 10° C.;

coolant fluid temperature at the outlet of the cooler for air conditioning use 57 Tco is 20° C.;

coolant fluid temperature at the inlets of the heat exchanging passages 39 and 40 of the first stage adsorption device Texi is 20° C.; and coolant fluid temperature at the outlets of the heat exchanging passages 41 and 42 of the second stage adsorption device Texo is 40° C., and in a case where the mixing tank 170 is provided:

coolant fluid temperature at the inlet of the cooler for air conditioning use 57 Tci is 10° C.;

coolant fluid temperature at the outlet of the cooler for air conditioning use 57 Tco is 20° C.;

coolant fluid temperature at the inlets of the heat exchanging passages 39 and 40 of the first stage adsorption device Texi is 25° C.; and coolant fluid temperature at the outlets of the heat exchanging passages 41 and 42 of the second stage adsorption device Texo is 40° C.

This can be organized in the form of a table as shown hereinafter:

TABLE I

| | No Mixing | Mixing |
|---|---|---|
| Texi | 20° C. | 25° C. |
| Texo | 40° C. | 40° C. |
| Tci | 10° C. | 10° C. |
| Tco | 20° C. | 20° C. |
| Efficiency η | 0.5 | 0.67 |

In this regard, when heat exchange efficiency is calculated for both a case wherein the mixing tank 170 is not provided and a case wherein the mixing tank 170 is provided, in a case wherein the mixing tank 170 is not provided:

$$\langle ETA \rangle = (Tco - Tci)/(Texo - Texi) = (20 - 10)/(40 - 20) = 0.5; \text{ and}$$

in a case wherein the mixing tank 170 is provided:

$$\langle ETA \rangle = (Tco - Tci)/(Texo - Texi) = (20 - 10)/(40 - 25) = 0.666;$$

and it is understood that efficiency of the heat exchanger is improved in the case where the mixing tank 170 is provided.

Figure 19:
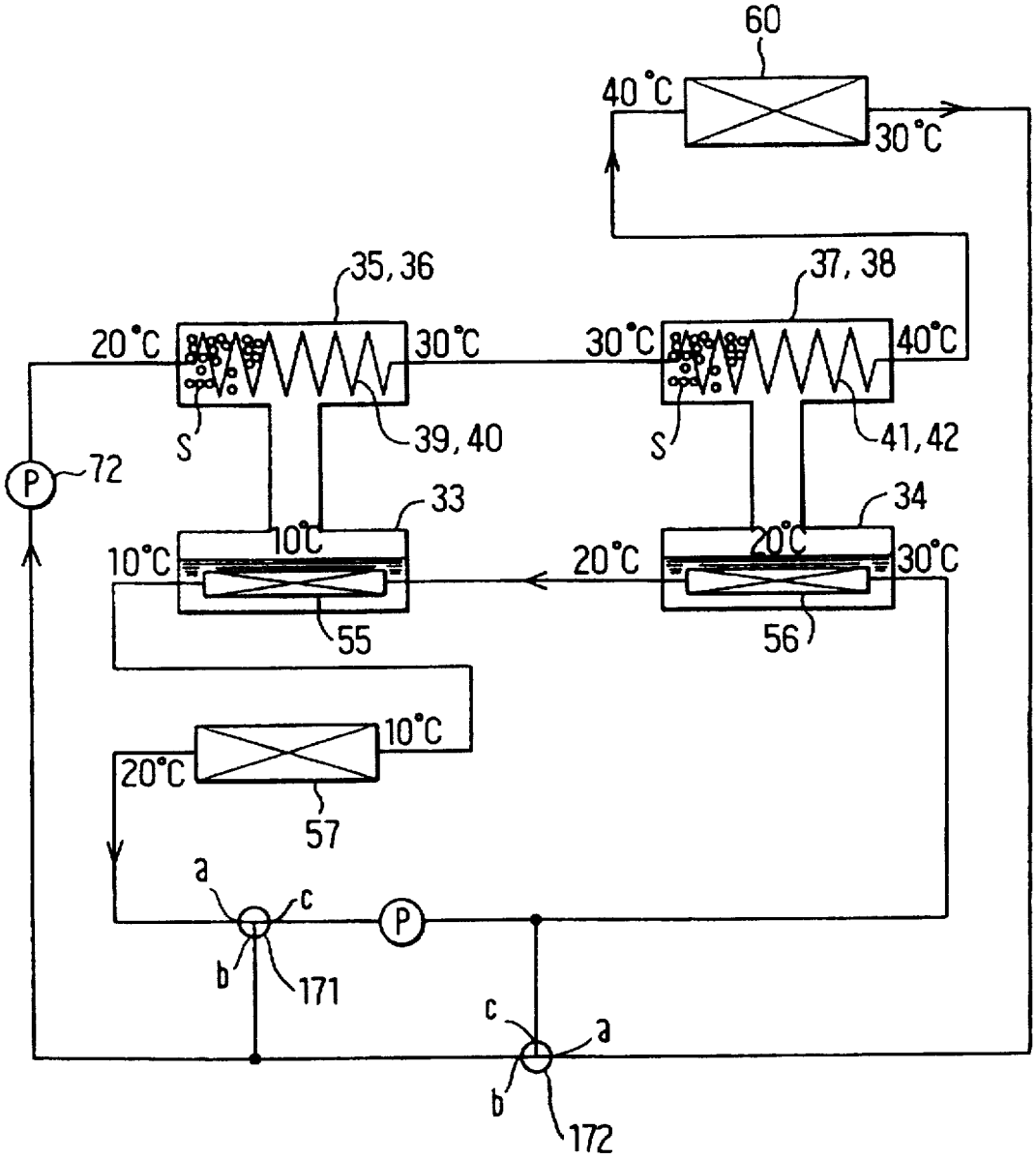
FIG. 19 shows an eleventh preferred embodiment of the present invention.

FIG. 19 shows an eleventh preferred embodiment according to this invention. This apparatus intermixes coolant fluid discharged from an outlet of a radiator 60 and coolant fluid discharged from an outlet of a cooler for air conditioning use 57 without employing a mixing tank 170, and coolant fluid subsequent to this mixing is supplied to a heat exchanger 56 of a second stage evaporator 34, and along with this, is supplied to a heat exchanging passage 39 of a first first stage adsorption device 35 or a heat exchanging passage 40 of a second first stage adsorption device 36.

According to this embodiment, two three-way valves 171 and 172 are provided as devices for adjusting the mixture ratio. The outlet of the cooler for air conditioning use 57 is connected to an inlet a of the three-way valve 171, and the outlet of the radiator 60 is connected to an inlet a of the three-way valve 172. Accordingly, one outlet b of the three-way valve 171 and one outlet b of the three-way valve 172 are integrated into a single unit and connected to an intake port of a pump 72, and along with this, another outlet c of the three-way valve 171 and another outlet c of the three-way valve 172 are integrated into a single unit and connected to the heat exchanger 56 of the second stage evaporator 34. Additionally, a pump 173 is connected to the other outlet side of the three-way valve 171.

According to the above-described structure, the mixture ratio of coolant fluid from the radiator 60 and coolant fluid from the cooler for air conditioning use 57 is varied and the mixture can be supplied to the heat exchanger 56 or the heat exchanging passage 39 or 40 by regulating a degree of opening of the outlets b and c of the three-way valves 171 and 172. In this case, when the degree of opening of the outlets b and c of the three-way valves 171 and 172 is the same, coolant fluid from the radiator 60 and coolant fluid from the cooler for air conditioning use 57 can be supplied at a mixture ratio of 50% each, similarly to the tenth embodiment depicted in FIG. 18. When the outlet C of the three-way valve 171 and the outlet C of the three-way valve 172 are closed, a single path with no mixing can be obtained, similarly to the second embodiment shown in FIG. 5. When the outlet b of the valve 171 and the outlet c of 172 are closed, coolant fluid can flow in two respectively independent paths, being a path of the cooler for air conditioning use 57, the heat exchanger 56 of the second stage evaporator 34, and a heat exchanger 55 of a first stage evaporator 33, and a path of the heat exchanging passage 39 or 40 of the first stage adsorption device 35 or 36, a heat exchanging passage 41 or 42 or a second stage adsorption device 37 or 38, and the cooler for air conditioning use 57.

Switching operation timing of four-way valves 73 and 74 for passage switching in a case wherein coolant fluid and heating fluid flow in series to the heat exchanging passages of the several stages of adsorption devices will be described hereinafter with reference to FIG. 20, taking a refrigeration apparatus according to the fifth embodiment shown in FIG. 9 and FIG. 10 as an example.

Figure 20A:
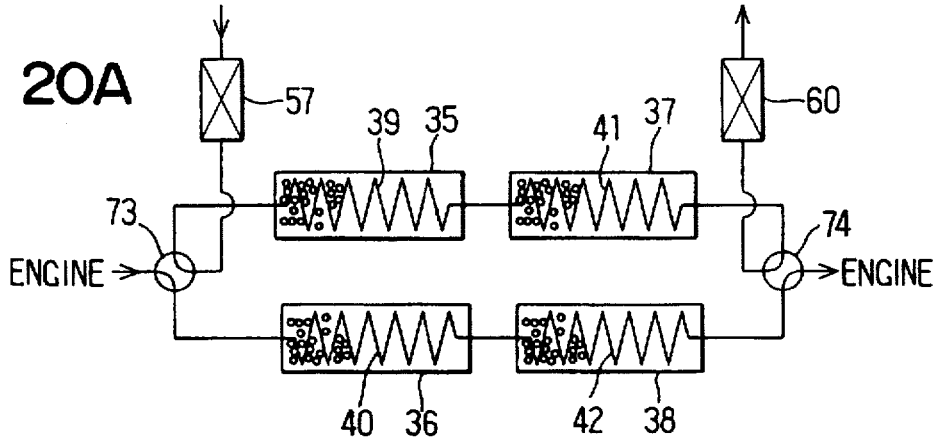
FIGS. 20A–20C are schematic structural views showing process switching in the embodiment.
Figure 20B:
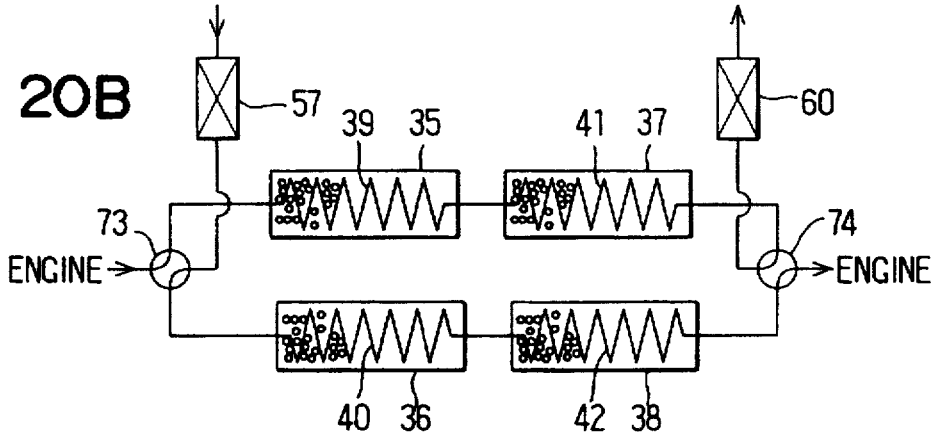
Figure 20C:
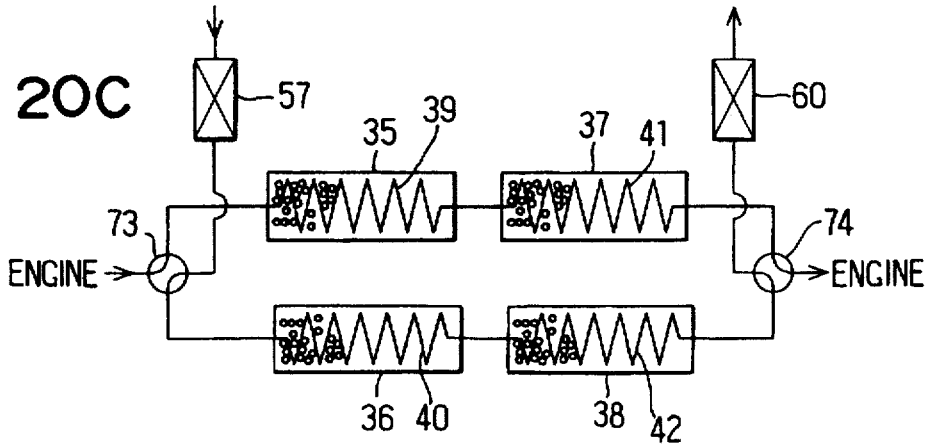

FIG. 20 (*a*) shows a state wherein the first first stage and second stage adsorption devices 35 and 37 are in the adsorption process, and the second first stage and second stage adsorption devices 36 and 38 are in the desorption process. In this state, coolant fluid from the cooler for air conditioning use 57 is successively supplied to the heat exchanging passages 39 and 41 of the first first stage and second stage adsorption devices 35 and 37, and engine coolant water is successively supplied to the heat exchanging passages 40 and 42 of the second first stage and second stage adsorption devices 36 and 38.

To switch the first first stage and second stage adsorption devices 35 and 37 to the desorption process along with switching the second first stage and second stage adsorption devices 36 and 38 to the adsorption process from this state, firstly, as shown in FIG. 20 (*b*), the four-way valve 73 alone is actuated and switched so that coolant fluid is supplied to the heat exchanging passage 40 of the second first stage adsorption device 36 and engine coolant water is supplied to the heat exchanging passage 39 of the first first stage adsorption device 35.

Thereupon, coolant fluid remaining within the heat exchanging passages 39 and 41 of the first first stage and second stage adsorption devices 35 and 37 is expelled by engine coolant water and sent to the radiator 60, and together with this, engine coolant water remaining within the heat exchanging passages 40 and 42 of the second first stage and second stage adsorption devices 36 and 38 is expelled by coolant fluid and sent to the engine.

Accordingly, when a predetermined interval elapses and coolant fluid remaining within the heat exchanging passages 39 and 41 of the first first stage and second stage adsorption devices 35 and 37 and engine coolant water remaining within the heat exchanging passages 40 and 42 of the second first stage and second stage adsorption devices 36 and 38 are discharged, the four-way valve 74 also is switched, and the first first stage and second stage adsorption devices 35 and 37 perform the desorption process, and along with this, the second first stage and second stage adsorption devices 36 and 38 perform the adsorption process.

In this way, coolant fluid and engine coolant water remaining within the adsorption devices 35 through 38 ordinarily are sent respectively to the radiator 60 and to the engine by causing switching operation of the four-way valve 74 to be delayed after switching operation of the three-way valve 73. This feed time [correctly: "DELAY"—SC] in the switching operation of the four-way valve 74 with respect to the switching operation of the three-way valve 73 shall be termed a "time lag."

According to an apparatus of this structure, however, in the state shown in FIG. 20 (*b*), coolant fluid immediately flows into the heat exchanging passage 40 of the second first stage adsorption device 36, but because the engine coolant water which was remaining within the heat exchanging passage 40 of the second first stage adsorption device 36 flows into the heat exchanging passage 42 of the second second stage adsorption device 38, the second second stage adsorption device 38 cannot shift to the adsorption process.

Similarly, engine coolant water immediately flows into the heat exchanging passage 39 of the first first stage adsorption device 35, but because the coolant fluid which was remaining within the heat exchanging passage 39 of the first first stage adsorption device 35 flows into the heat exchanging passage 41 of the first second stage adsorption device 37, the first second stage adsorption device 37 cannot shift to the desorption process. In this way, the second stage adsorption devices 37 and 38 enter a state wherein neither adsorption nor desorption can be executed during the time lag of the four-way valves 73 and 74, and cooling capacity is no longer exhibited.

Figure 21A:
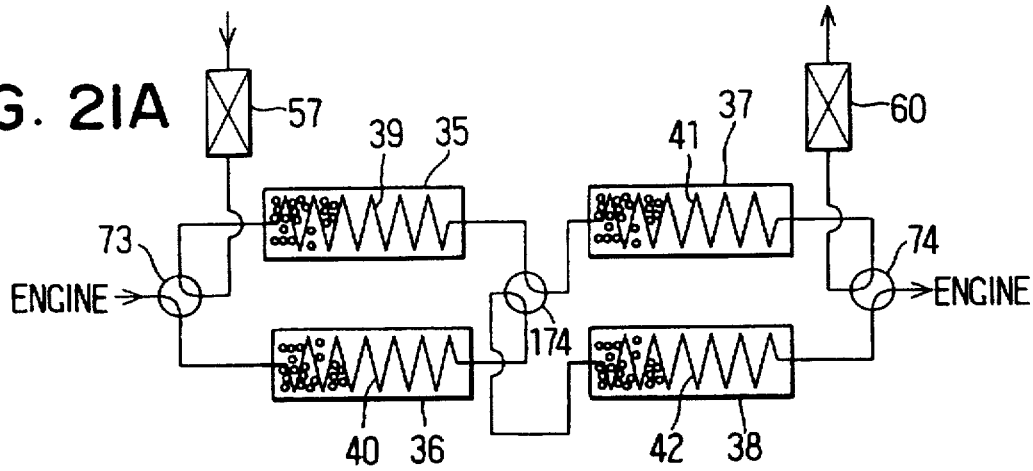
FIGS. 21A–21C show process switching in a twelfth preferred embodiment of the present invention.
Figure 21B:
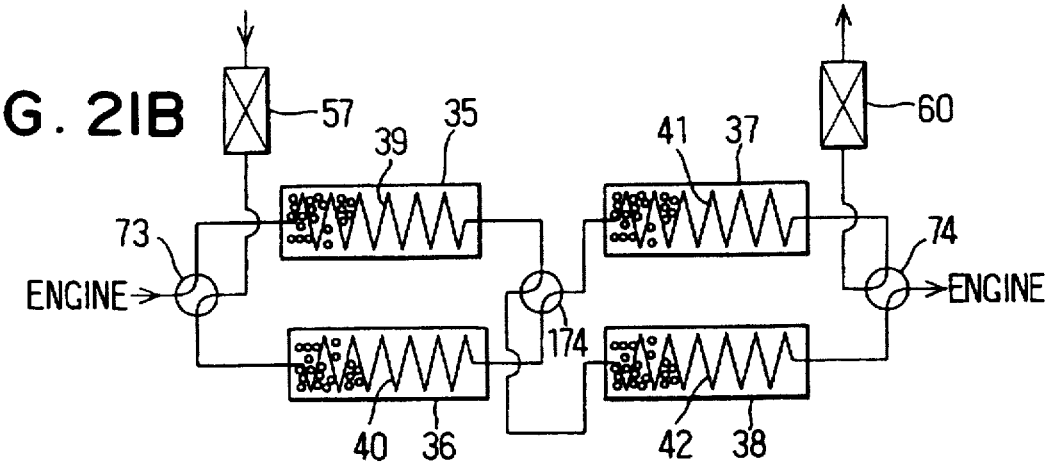
Figure 21C:
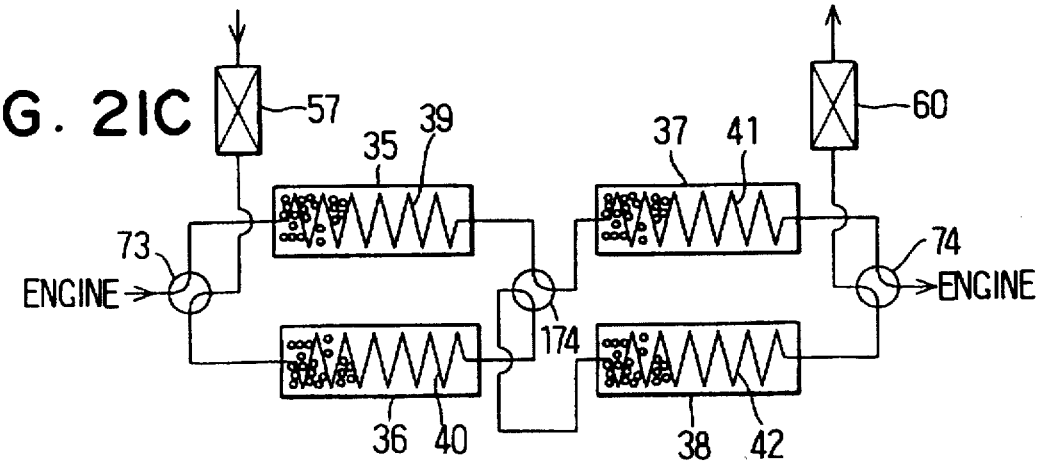

A twelfth embodiment of this invention shown in FIG. 21 exists to solve such problems. This embodiment differs from the fifth embodiment in disposing a four-way valve 174 as a passage switching device between heat exchanging passages 39 and 40 of first stage adsorption devices 35 and 36 on the one hand and heat exchanging passages 41 and 42 of second stage adsorption devices 37 and 38 on the other hand.

That is to say, outlets of the heat exchanging passages 39 and 40 of the first stage adsorption devices 35 and 36 and inlets of the heat exchanging passages 41 and 42 of the second stage adsorption devices 37 and 38 are respectively connected to one of the several ports of the four-way valve 174. Accordingly, a state wherein the heat exchanging passage 39 of the first first stage adsorption device 35 and the heat exchanging passage 41 of the first second stage adsorption device 37 are connected, and along with this, the heat exchanging passage 40 of the second first stage adsorption device 36 and the heat exchanging passage 42 of the second second stage adsorption device 38 are connected (i.e., a first connected state), and a state wherein the heat exchanging passage 39 of the first first stage adsorption device 35 and the heat exchanging passage 42 of the second second stage adsorption device 38 are connected, and along with this, the heat exchanging passage 40 of the second first stage adsorption device 36 and the heat exchanging passage 41 of the second second stage adsorption device 37 are connected (i.e., a second connected state), are switched due to switching operation of the four-way valve 174.

A mode of operation of the above-described structure will be described hereinafter. FIG. 20 (*a*) shows a state wherein the first first stage and second stage adsorption devices 35 and 37 are in the adsorption process, and the second first stage and second stage adsorption devices 36 and 38 are in the desorption process. In this state, the four-way valve 174 is in the first switched state, coolant fluid from the cooler for air conditioning use 57 is successively supplied to the heat exchanging passages 39 and 41 of the first first stage and second stage adsorption devices 35 and 37, and engine coolant water is successively supplied to the heat exchanging passages 40 and 42 of the second first stage and second stage adsorption devices 36 and 38.

To switch the first first stage and second stage adsorption devices 35 and 37 to the desorption process along with switching the second first stage and second stage adsorption devices 36 and 38 to the adsorption process from this state, firstly, as shown in FIG. 20 (*b*), the four-way valve 73 is actuated and switched so that coolant fluid is supplied to the heat exchanging passage 40 of the second first stage adsorption device 36 and engine coolant water is supplied to the heat exchanging passage 39 of the first first stage adsorption device 35. In synchronization with this switching of the four-way valve 73, the four-way valve enters the second switched state.

Thereupon, coolant fluid remaining within the heat exchanging passage 39 of the first first stage adsorption device 35 is expelled by engine coolant water and supplied to the heat exchanging passage 42 of the second second stage adsorption device 38, and together with this, engine coolant water remaining within the heat exchanging passage 40 of the second first stage adsorption device 36 is expelled by coolant fluid from the cooler for air conditioning use 57 and supplied to the heat exchanging passage 41 of the first second stage adsorption device 37.

Because of this, engine coolant water remaining within the heat exchanging passage 42 of the second second stage adsorption device 38 is expelled by coolant fluid from the heat exchanging passage 39 and returned to the engine, and along with this, coolant fluid remaining within the heat exchanging passage 41 of the first second stage adsorption device 37 is expelled by engine coolant water and sent to the radiator 60.

In this way, the heat exchanging passages 39 through 42 of the several stages of adsorption devices 35 through 38 assume a state wherein heat exchanging passages of adsorption devices having the same execution process before and after switching are connected in series, and so coolant fluid and engine coolant water required to perform the process after switching can be received from heat exchanging passages of other adsorption devices.

Accordingly, when coolant fluid remaining within the heat exchanging passages 39 and 41 of the first first stage and second stage adsorption devices 35 and 37 and engine coolant water remaining within the heat exchanging passages 40 and 42 of the second first stage and second stage adsorption devices 36 and 38 are expelled, the four-way valve 174 is switched to the second switched state, and simultaneously thereto, the four-way valve 74 also is switched, and the first first stage and second stage adsorption devices 35 and 37 perform the desorption process, and along with this, the second first stage and second stage adsorption devices 36 and 38 perform the adsorption process.

In this way, according to this embodiment, when the several adsorption devices 35 through 38 are switched between the desorption process and the adsorption process, the heat exchanging passages 39 and 40 of the earlier stage adsorption devices 35 and 36 supply required fluid to the latter stage adsorption devices 37 and 38, and so time required to expel unnecessary fluid remaining in the heat exchanging passages 39 through 42 of the several adsorption devices 35 through 38 becomes equivalent to time to expel fluid remaining in the heat exchanging passage of one adsorption device, time lag is only about half that of the apparatus in FIG. 20, and processes can be switched within a short time.

Figure 22:
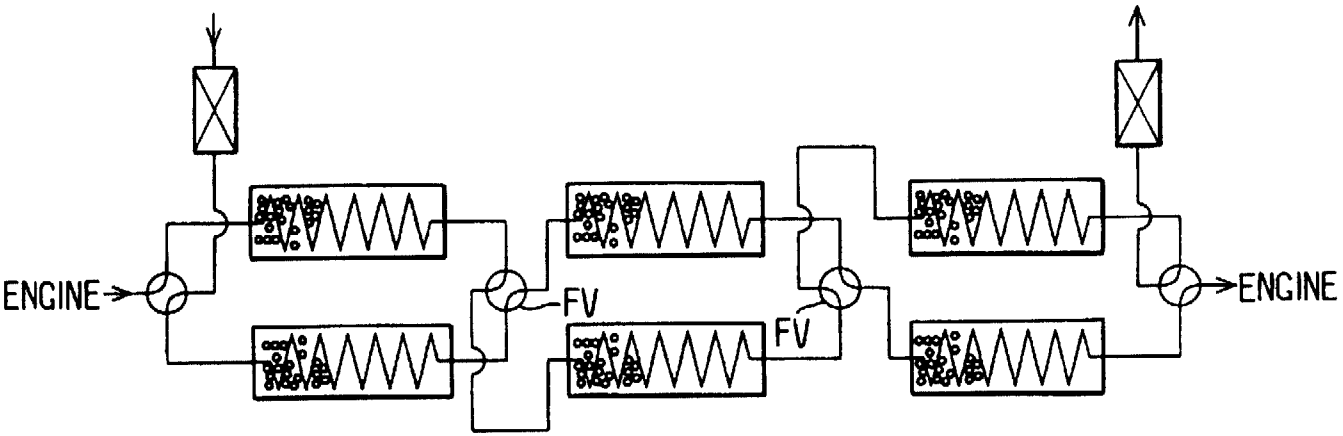
FIG. 22 shows a thirteenth preferred embodiment of the present invention.

The way of thinking for this time lag reduction of the twelfth embodiment is not exclusively restricted to an apparatus provided with two stages of adsorption devices, but can be similarly applied even in a case wherein adsorption devices are provided in three stages or in a greater number of stages. A thirteenth embodiment shown in FIG. 22 is an apparatus providing three stages of adsorption devices. By connecting heat exchanging passages of adsorption devices of such neighboring stages with a four-way valve FV, time lag can be shortened to the time required to expel fluid from the heat exchanging passage of the first stage adsorption device.

This invention is not restricted to the embodiments described hereinabove and shown in the drawings, but may be expanded or modified as will be described hereinafter.

The four-way valves 61, 62, 68 through 71, 73, and 74, the three-way valves 105 through 119, the four-way valves 146 and 160, and the three-way valves 147 through 159 correspond to passage switching devices for supplying coolant fluid and heating fluid alternately to the adsorption devices, but these are not exclusively limited to four-way or three-way valves and depending on piping configuration may be a combination of switching valves.

The switching valves 43 through 50 and 121 through 140 correspond to refrigerant passage switching devices for causing pairs of adsorption devices of several stages to be selectively communicated with a condenser or evaporator, but these also may be three-way valves or four-way valves.

The several stages of adsorption devices need not necessarily be provided in pairs, and may be a structure wherein a single adsorption device alternately executes adsorption and desorption.

In FIG. 12, the first stage through fourth stage heat exchangers 90 through 93 may be structured to be connected in series to at least adjacent heat exchangers 90 and 91, 91 and 92, 92 and 93, 90 through 92, 91 through 93, or 90 through 93, supply coolant fluid in series to the cooler for air conditioning use 57 and the heat exchanger of the first stage adsorption device, supply coolant fluid in series to the heat exchanging passages of the first stage and second stage adsorption devices, supply coolant fluid in series to the heat exchanging passages of the second stage and third stage adsorption devices, supply coolant fluid in series to the cooler for air conditioning use 57 and the heat exchanging passages of the first stage and second stage adsorption devices, or supply coolant fluid in series to the heat exchanging passages of the first stage through third stage adsorption devices.

Furthermore, in FIG. 12, the fifth stage heat exchangers 91 through 94 may be structured to be connected in series to at least earlier stage heat exchangers 93, 93 and 92, or 93 through 91, allow coolant fluid to flow in series to the heat exchanging passages of the third stage through fifth stage adsorption devices, allow coolant fluid to flow in series to the heat exchanging passages of the second stage through fifth stage adsorption devices, or allow coolant fluid to flow in series to the heat exchanging passages of the first stage through fifth stage adsorption devices, and respectively return these to the radiator 60.

A plurality of condensers 32 may be provided.

In FIG. 5, FIG. 8, and FIG. 11, the two evaporators 33 and 33' and 34 and 34' disposed in the several stages are mutually connected by capillary tubing so that refrigerant circulates, but the capillary tubing may be eliminated. The reason for this is because refrigerant liquid condensed by the evaporators 33, 33', 34, and 34' during desorption by the adsorption devices 35 through 38 may be collected as is in the respective evaporators, and refrigerant liquid collected within the evaporators 33, 33', 34, and 34' may evaporated during adsorption by the adsorption devices 35 through 38.

Although the present invention has been fully described in connection with the preferred embodiments thereof with reference to the accompanying drawings, it is to be noted that various changes and modifications will become apparent to those skilled in the art. Such changes and modifications are to be understood as being included within the scope of the present invention as defined by the appended claims.

What is claimed is:

1. An adsorptive-type refrigeration apparatus, comprising:

at least one condenser for condensing refrigerant;

a plurality of stages of evaporators for evaporating refrigerant from said condenser;

a plurality of stages of adsorption devices in correspondence with said plurality of stages of evaporators, each of said adsorption devices having an adsorbent for adsorbing refrigerant vapor vaporized in said several stages of evaporators by being chilled and for desorbing and releasing refrigerant vapor to said condenser by being heated;

a heat exchanging passage, in said stages of adsorption devices, for receiving a supply of coolant fluid and for cooling said adsorbent;

a radiator for chilling fluid from said heat exchanging passage of at least a final stage adsorption device among said plurality of stages of adsorption devices; and a cooler for performing heat exchange between outside air and fluid chilled by at least a first stage evaporator among said plurality of stages of evaporators;

characterized in that a later stage evaporator in said plurality of evaporators is further for cooling coolant fluid to be supplied to said heat exchanging passage of at least a prior stage of said adsorption devices, and said heat exchanging passages of at least two mutually adjacent stages of adsorption devices among said plurality of stages of adsorption devices are connected in series so that said coolant fluid flows from a heat exchanging passage of an adsorption device of a prior stage side to a heat exchanging passage of an adsorption device of a latter stage side.

2. An adsorptive-type refrigeration apparatus as recited in claim 1, wherein a quantity of said adsorbent decreases the farther along the latter stage side of the adsorption device in said plurality of stages of adsorption devices.

3. An adsorptive-type refrigeration apparatus as recited in claim 2, wherein a particle size of said adsorbent decreases the farther along the latter stage side of the adsorption device among said plurality of stages of adsorption devices.

4. An adsorptive-type refrigeration apparatus as recited in claim 1, wherein a particle size of said adsorbent decreases the farther along the latter stage side of the adsorption device among said plurality of stages of adsorption devices.

5. An adsorptive-type refrigeration apparatus as recited in claim 1, wherein:

said condenser is provided in correspondence to said several stages of evaporators and adsorption devices so that a circulating system of refrigerant is independently established for each of said several stages; and among refrigerant sealed within these several stages of condensers, evaporators and adsorption devices, a freezing point lowering agent is intermixed in refrigerant of a required stage of a forward stage side.

6. An adsorptive-type refrigeration apparatus as recited in claim 1, wherein:

said condenser is provided in correspondence to said stages of evaporators and adsorption devices so that a circulating system of refrigerant is independently established for each of said several stages; and among refrigerant sealed within these stages of condensers, evaporators and adsorption devices, a required stage on a forward stage side employs an alcohol-based substance as refrigerant and employs activated carbon as adsorbent to adsorb said refrigerant.

7. An adsorptive-type refrigeration apparatus, comprising:

a condenser for condensing refrigerant;

a plurality of stages of evaporators for evaporating refrigerant from said condenser;

a plurality of stages of adsorption devices in correspondence with said stages of evaporators, each of said adsorption devices having an adsorbent for adsorbing refrigerant vapor vaporized in said stages of evaporators by being chilled and for desorbing and releasing refrigerant vapor to said condenser by being heated;

a heat exchanging passage in said stages of adsorption devices for receiving a supply of coolant fluid and for cooling said adsorbent;

a radiator for chilling fluid from said heat exchanging passage of at least a final stage adsorption device among said plurality of stages of adsorption devices; and a cooler for performing heat exchange between outside air and fluid chilled by at least a first stage evaporator among said plurality of stages of evaporators;

characterized in that said evaporator is further for generating coolant fluid to be supplied to said heat exchanging passage of at least a prior stage of said adsorption devices, and said heat exchanging passages of at least two mutually adjacent stages of adsorption devices among said plurality of stages of adsorption devices are connected in series so that said coolant fluid flows and is successively chilled from an evaporator of a latter stage side by an evaporator of a prior stage side.

8. An adsorptive-type refrigeration apparatus as recited in claim 7, wherein a quantity of said adsorbent decreases the farther along the latter stage side of the adsorption device in said plurality of stages of adsorption devices.

9. An adsorptive-type refrigeration apparatus as recited in claim 8, wherein a particle size of said adsorbent decreases the farther along the latter stage side of the adsorption device among said plurality of stages of adsorption devices.

10. An adsorptive-type refrigeration apparatus as recited in claim 7, wherein a particle size of said adsorbent decreases the farther along the latter stage side of the adsorption device among said plurality of stages of adsorption devices.

11. An adsorptive-type refrigeration apparatus as recited in claim 7, wherein:

said condenser is provided in correspondence to said several stages of evaporators and adsorption devices so that a circulating system of refrigerant is independently established for each of said several stages; and among refrigerant sealed within these several stages of condensers, evaporators and adsorption devices, a freezing point lowering agent is intermixed in refrigerant of a required stage of a forward stage side.

12. An adsorptive-type refrigeration apparatus as recited in claim 7, wherein:

said condenser is provided in correspondence to said stages of evaporators and adsorption devices so that a circulating system of refrigerant is independently established for each of said several stages; and among refrigerant sealed within these stages of condensers, evaporators and adsorption devices, a required stage on a forward stage side employs an alcohol-based substance as refrigerant and employs activated carbon as adsorbent to adsorb said refrigerant.

13. An adsorptive-type refrigeration apparatus, comprising:

a condenser for condensing refrigerant;

a plurality of stages of evaporators for evaporating refrigerant from said condenser;

a plurality of heat exchangers in said stages of evaporators; and a plurality of stages of adsorption devices in correspondence with said stages of evaporators, each of said adsorption devices having an adsorbent for adsorbing refrigerant vapor vaporized in said stages of evaporators by being chilled and for desorbing and releasing refrigerant vapor to said condenser by being heated;

characterized in that said apparatus further comprises a radiator for radiating heat to an external area connected in series with said heat exchangers of said stages of evaporators; and coolant fluid successively chilled by said heat exchangers from said final stage heat exchanger to said first stage heat exchanger subsequently to having been cooled by said radiator is successively supplied serially via a cooler to chill air to a heat exchanging passage of said adsorption devices to said final stage adsorption device.

14. An adsorptive-type refrigeration apparatus as recited in claim 13, wherein a filled quantity of said adsorbent decreases the farther along the latter stage side of the adsorption device in said plurality of stages of adsorption devices.

15. An adsorptive-type refrigeration apparatus as recited in claim 14, wherein a particle size of said adsorbent decreases the farther along the latter stage side of the adsorption device among said plurality of stages of adsorption devices.

16. An adsorptive-type refrigeration apparatus as recited in claim 13, wherein a particle size of said adsorbent decreases the farther along the latter stage side of the adsorption device among said plurality of stages of adsorption devices.

17. An adsorptive-type refrigeration apparatus as recited in claim 13, wherein:

said condenser is provided in correspondence to said several stages of evaporators and adsorption devices so that a circulating system of refrigerant is independently established for each of said several stages; and among refrigerant sealed within these several stages of condensers, evaporators and adsorption devices, a freezing point lowering agent is intermixed in refrigerant of a required stage of a forward stage side.

18. An adsorptive-type refrigeration apparatus as recited in claim 13, wherein:

said condenser is provided in correspondence to said stages of evaporators and adsorption devices so that a circulating system of refrigerant is independently established for each of said several stages; and among refrigerant sealed within these stages of condensers, evaporators and adsorption devices, a required stage on a forward stage side employs an alcohol-based substance as refrigerant and employs activated carbon as adsorbent to adsorb said refrigerant.

19. An adsorptive-type refrigeration apparatus as recited in claim 13, wherein coolant fluid discharged from said radiator and coolant fluid discharged from said cooler are intermixed and supplied to a heat exchanger of said final stage evaporator and a heat exchanging passage of said first stage adsorption device.

20. An adsorptive-type refrigeration apparatus as recited in claim 13, wherein:

said several stages of adsorption devices are disposed in pairs, and said pairs of adsorption devices are structured to alternately execute an adsorbing process and a desorbing process through a relationship wherein when one device in said pair performs adsorption through coolant fluid being supplied to said heat exchanging passage thereof, the other device in said pair performs desorption through heating fluid being supplied to said heat exchanging passage thereof; and when these processes are switched, a heat exchanging passage of an adsorption device which performs adsorption in one of said pairs is connected to a heat exchanging passage of an adsorption device which performs desorption in a pair closer to said final stage adsorption device, and a heat exchanging passage of an adsorption device which performs desorption in said one of said pairs is connected to a heat exchanging passage of an adsorption device which performs adsorption in said pair closer to said final stage adsorption device; and then, said heat exchanging passage of said adsorption device which performs adsorption in said one of said pairs is connected to said heat exchanging passage of said adsorption device which performs adsorption in said pair closer to said final stage adsorption device and said heat exchanging passage of said adsorption device which performs desorption in said one of said pairs is connected to said adsorption device which performs desorption in said pair closer to said final stage.

* * * * *